US009539698B2

(12) United States Patent
Niemeyer et al.

(10) Patent No.: US 9,539,698 B2
(45) Date of Patent: Jan. 10, 2017

(54) GRIND HARDENING METHOD

(71) Applicant: Mori Seiki USA, Hoffman Estates, IL (US)

(72) Inventors: Nils Niemeyer, Kempen (DE); Tobias Foeckerer, Munich (DE); Nitin Chaphalkar, Schaumburg, IL (US); Gregory A. Hyatt, South Barrington, IL (US)

(73) Assignee: MORI SEIKI CO., LTD., Nara (JP)

( * ) Notice: Subject to any disclaimer, the term of this patent is extended or adjusted under 35 U.S.C. 154(b) by 938 days.

(21) Appl. No.: 13/836,329

(22) Filed: Mar. 15, 2013

(65) Prior Publication Data

US 2013/0273811 A1 Oct. 17, 2013

Related U.S. Application Data

(60) Provisional application No. 61/624,483, filed on Apr. 16, 2012.

(51) Int. Cl.
*B24B 51/00* (2006.01)
*B24B 5/04* (2006.01)
(Continued)

(52) U.S. Cl.
CPC ..... *B24B 51/00* (2013.01); *B24B 5/02* (2013.01); *B24B 55/02* (2013.01); *C21D 7/00* (2013.01)

(58) Field of Classification Search
CPC ..... B24B 51/00; B24B 5/04; B24B 5/01; B24B 5/37
(Continued)

(56) References Cited

U.S. PATENT DOCUMENTS 6,039,634 A * 3/2000 Bach ..... B23Q 1/4857 451/49
7,797,074 B2 * 9/2010 Hyatt ..... B23B 3/168 700/164
(Continued)

OTHER PUBLICATIONS

K. Salonitis, T. Chondros, G. Chryssolouris, Grinding wheel effect in the grind-hardening process, May 26, 2007, pp. 48-58, Springer-Verlag London, Univercity of Patras, Patras 261 10 Greece.
K. Salonitis, G. Chryssolouris, Cooling in grind-hardening operations, Mar. 30, 2006, pp. 285-297, Springer-Verlag London, University of Patras, Patras 261 10, Greece.
(Continued)

*Primary Examiner* — Robert Rose
(74) *Attorney, Agent, or Firm* — Miller, Matthias & Hull LLP

(57) ABSTRACT

A method of grind hardening a workpiece is provided. The method may include securing the workpiece in a workpiece retainer and a grind tool in a tool retainer, rotating the grind tool in a first angular direction at a first angular speed, controlling the workpiece and tool retainers such that the grind tool engages the workpiece, and controlling the workpiece and tool retainers such that the grind tool is guided along a grinding track of the workpiece. The grind tool may engage and/or disengage the workpiece at portions of sacrificial material disposed thereon. Coolant and cleaning nozzles may be provided and controlled such that at least a portion of the coolant from the coolant nozzle is diverted to the cleaning nozzle in a manner which reduces heat dissipation, improves thermal efficiency of the grind hardening and reduces loading of the grind tool.

25 Claims, 17 Drawing Sheets

(51) Int. Cl.

| | |
|---|---|
| ***B24B 5/37*** | (2006.01) |
| ***B24B 55/02*** | (2006.01) |
| ***B24B 5/02*** | (2006.01) |
| ***C21D 7/00*** | (2006.01) |

(58) Field of Classification Search
USPC ..... 451/5, 49, 8, 9, 10, 58
See application file for complete search history.

(56) References Cited

U.S. PATENT DOCUMENTS

| | | | | |
|---|---|---|---|---|
| 8,602,845 | B2 * | 12/2013 | Guo ..... | B23Q 15/12 451/28 |
| 2010/0278606 | A1 | 11/2010 | Hyatt et al. | |
| 2011/0136408 | A1 | 6/2011 | Frazee et al. | |

OTHER PUBLICATIONS

P.Q. Ge, et al., Prediction of the Residual Stress in Grind-hardening with Thermal-Phase Transformation Stress Coupled Analysis, Shandong University, 2009, Jinan 250061, China.

Han Zheng-Tong, Zhang Ning-Ju, Gao Ding, Yang Gang, Research into Grinding Hardening of Microalloyed Non-quenched and Tempered Steel, Jun. 2007, Journalof China University of Mining & Technology, vol. 17 No. 2, pp. 238-241.

Zhang, L.C., (2007) 'Grind-hardening of steel surfaces: a focused review', Int. J. Abrasive Technology, vol. 1, No. 1, pp. 3-36.

Michael F. Zah, Ekkard Brinksmeier, Carsten Heinzel, Jens-Walter Huntemann, Tobias Fockerer, Experimental and numerical identification of process parameters of grind-hardening and resulting part distortions, Jul. 31, 2009, Prod. Eng. Res. Devel. (2009), pp. 271-279.

* cited by examiner

GRIND HARDENING METHOD

BACKGROUND

Technical Field

The present disclosure generally relates to computed numerically controlled machine tools, and more particularly, to methods and apparatus for performing grind hardening processes using computer controlled machine tools.

Description of the Related Art

Computed Numerically Controlled (CNC) machine tools are generally known for forming metal and wooden parts. Such machine tools include lathes, milling machines, grinding machines, and other tool types. More recently, machining centers have been developed, which provide a single machine having multiple tool types and capable of performing multiple different machining processes. Machining centers may generally include one or more tool retainers, such as spindle retainers and turret retainers holding one or more tools, and a workpiece retainer, such as a pair of chucks. The workpiece retainer may be stationary or move (in translation and/or rotation) while a tool is brought into contact with the workpiece, thereby removing material from the workpiece.

Often, a metal workpiece which has been soft-machined using such machine centers, must undergo a hardening process prior to a grinding or other finishing process. A hardening process typically involves heating, annealing and cooling the metal within a relatively short period of time. Conventional hardening processes use induction coils, gas burners, or the like, in order to heat the metal to temperatures above respective critical temperatures, and subsequently use cooling baths, or the like, to cool the metal to room temperature. The heating and cooling steps of such hardening processes, however, consume significant amounts of energy and resources. Furthermore, the added handling required to remove the soft-machined workpiece from the machine center, harden the workpiece, and reinstall the hardened workpiece back into the machine center for finishing consumes added time and excess labor.

More recent hardening procedures have combined the grinding and hardening processes into a single grind hardening process to overcome some of the drawbacks associated with more conventional hardening techniques. Specifically, the friction that is generated between the grind tool and the workpiece during the grinding process is used to heat the surfaces of the workpiece to temperatures sufficient for hardening. The relatively cooler core of the workpiece then serves as a heat sink which rapidly absorbs the heat from the surface layer to ultimately produce hardening results that are comparable to those of more conventional methods. Although such schemes may provide some improvements, due to the geometry of the grind wheel as well as the manner in which the grind wheel engages a workpiece, currently existing grind hardening processes are unable to provide uniform or adequately controlled hardened surfaces. Furthermore, existing schemes lack measures for monitoring a hardening process, and thus, are unable to more finely control the degree of hardness that is applied to a work surface. Currently existing schemes also use an excess of energy and resources in order to cool or clean the contact area between the grind tool and the workpiece during a grind hardening process.

SUMMARY OF THE DISCLOSURE

In accordance with one aspect of the present disclosure, an apparatus for grind hardening a workpiece having a work surface and sacrificial material disposed thereon is provided. The apparatus may include a workpiece retainer configured to movably support the workpiece, a tool retainer configured to be movable relative to the workpiece retainer, a grind tool rotatably disposed in the tool retainer, and a computer control system including a computer readable medium having computer executable code disposed thereon and being in operative communication with each of the workpiece retainer and the tool retainer. The executable code may configure the control system to rotate the grind tool in a first angular direction at a first angular speed, control one or more of the workpiece retainer and the tool retainer such that the grind tool engages contact with the workpiece in a manner which remove at least a portion of the sacrificial material during the engagement, and control one or more of the workpiece retainer and the tool retainer such that the grind tool is guided along a grinding track defined on the work surface and generating sufficient heat on the work surface.

In accordance with another aspect of the present disclosure, an apparatus for grind hardening a workpiece having a work surface is provided. The apparatus may include a workpiece retainer configured to movably support the workpiece, a tool retainer configured to be movable relative to the workpiece retainer, a grind tool rotatably disposed in the tool retainer, a coolant nozzle and at least one cleaning nozzle, and a computer control system including a computer readable medium having computer executable code disposed thereon and being in operative communication with each of the workpiece retainer, the tool retainer, the coolant nozzle and the at least one cleaning nozzle. Each of the coolant and cleaning nozzles may be configured to selectively dispense a coolant in proximity to a contact area between the grind tool and the workpiece. The executable code of the computer control system may configure the control system to rotate the grind tool in a first angular direction at a first angular speed, control one or more of the workpiece retainer and the tool retainer such that the grind tool engages contact with the workpiece, control one or more of the workpiece retainer and the tool retainer such that the grind tool is guided along a grinding track defined on the work surface, and control one or more of the coolant and cleaning nozzles such that at least a portion of the coolant from the coolant nozzle is diverted to the cleaning nozzle in a manner which reduces heat dissipation, improves thermal efficiency of the grind hardening and reduces loading of the grind tool.

In accordance with another aspect of the present disclosure, a method of grind hardening a workpiece having a work surface and sacrificial material disposed thereon is provided. The method may secure the workpiece in a workpiece retainer, secure a grind tool in a rotatable tool retainer, rotate the grind tool in a first angular direction at a first angular speed, control one or more of the workpiece retainer and the tool retainer such that the grind tool engages contact with the workpiece, and control one or more of the workpiece retainer and the tool retainer such that the grind tool is guided along a grinding track defined on the work surface of the workpiece and generating substantially uniform and sufficient heat on the work surface. The grind tool may remove at least a portion of the sacrificial material during the engagement.

In accordance with yet another aspect of the present disclosure, a method of grind hardening a workpiece having a substantially rounded cross-section with a work surface and sacrificial material disposed thereon is provided. The method may secure the workpiece in a rotatable workpiece retainer, secure a grind tool in a rotatable tool retainer, rotate the grind tool in a first angular direction at a first angular speed, control the tool retainer such that the grind tool engages contact with the workpiece in a direction that is substantially tangent with the workpiece, and rotate the workpiece relative to the grind tool in the first angular direction at a second angular speed that is substantially less than the first angular speed such that the grind tool is guided along a grinding track circumferentially defined on the work surface of the workpiece. The grind tool may remove at least a portion of the sacrificial material during the engagement.

BRIEF DESCRIPTION OF THE DRAWINGS

For a more complete understanding of the disclosed methods and apparatus, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatus or which render other details difficult to perceive may have been omitted. It should be understood, of course, that this disclosure is not limited to the particular embodiments illustrated herein.

DETAILED DESCRIPTION

Any suitable apparatus may be employed in conjunction with the methods disclosed herein. In some embodiments, the methods are performed using a computer numerically controlled machine, illustrated generally in FIGS. 1-9. A computer numerically controlled machine is itself provided in other embodiments. The machine 100 illustrated in FIGS. 1-9 is an NT-series machine, versions of which are available from DMG/Mori Seiki USA, the assignee of the present application. Other machines, however, may be used to perform the methods disclosed herein.

Figure 1:
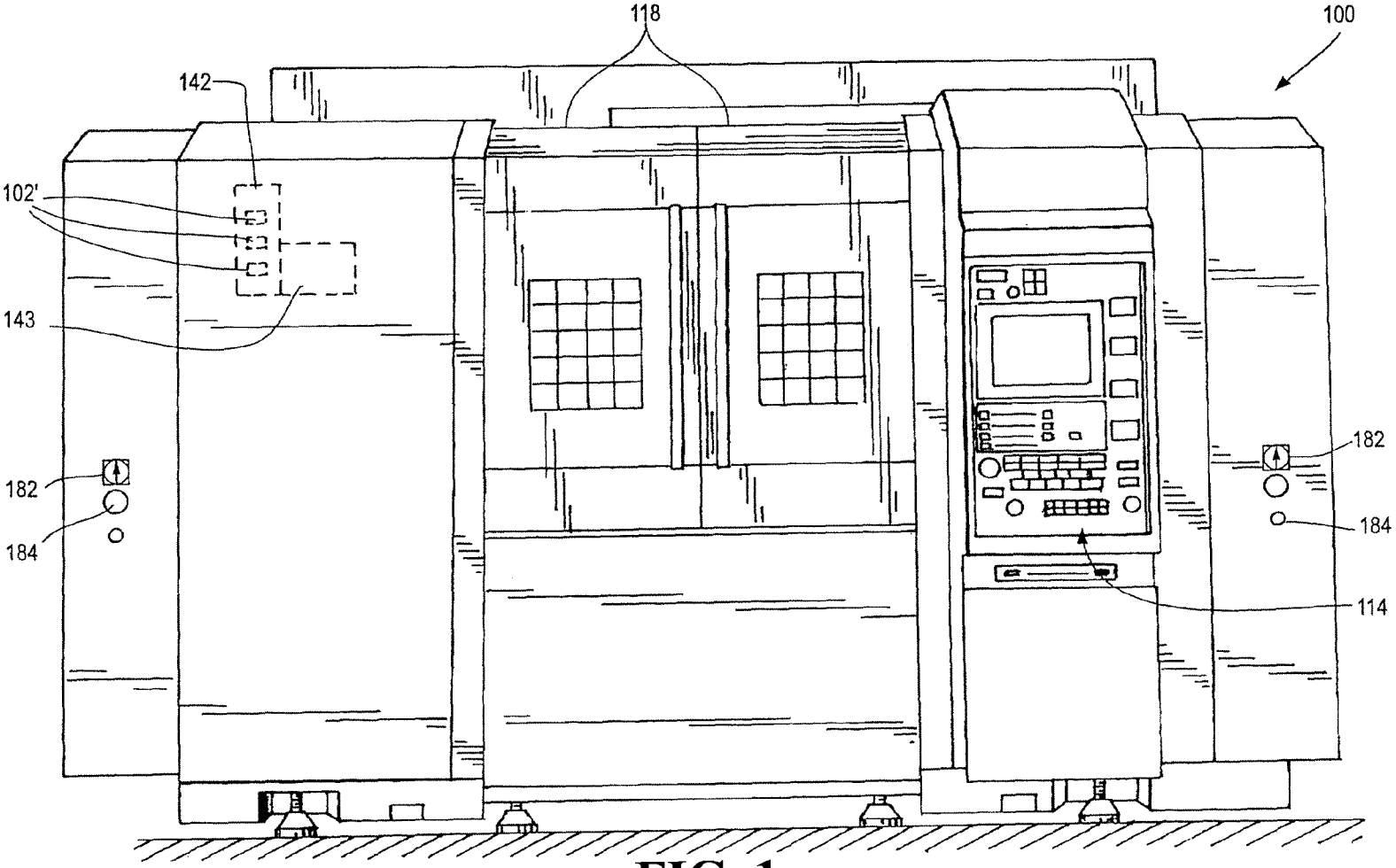
FIG. 1 is a front elevation of a computer numerically controlled machine in accordance with one embodiment of the present invention, shown with safety doors closed.
Figure 2:
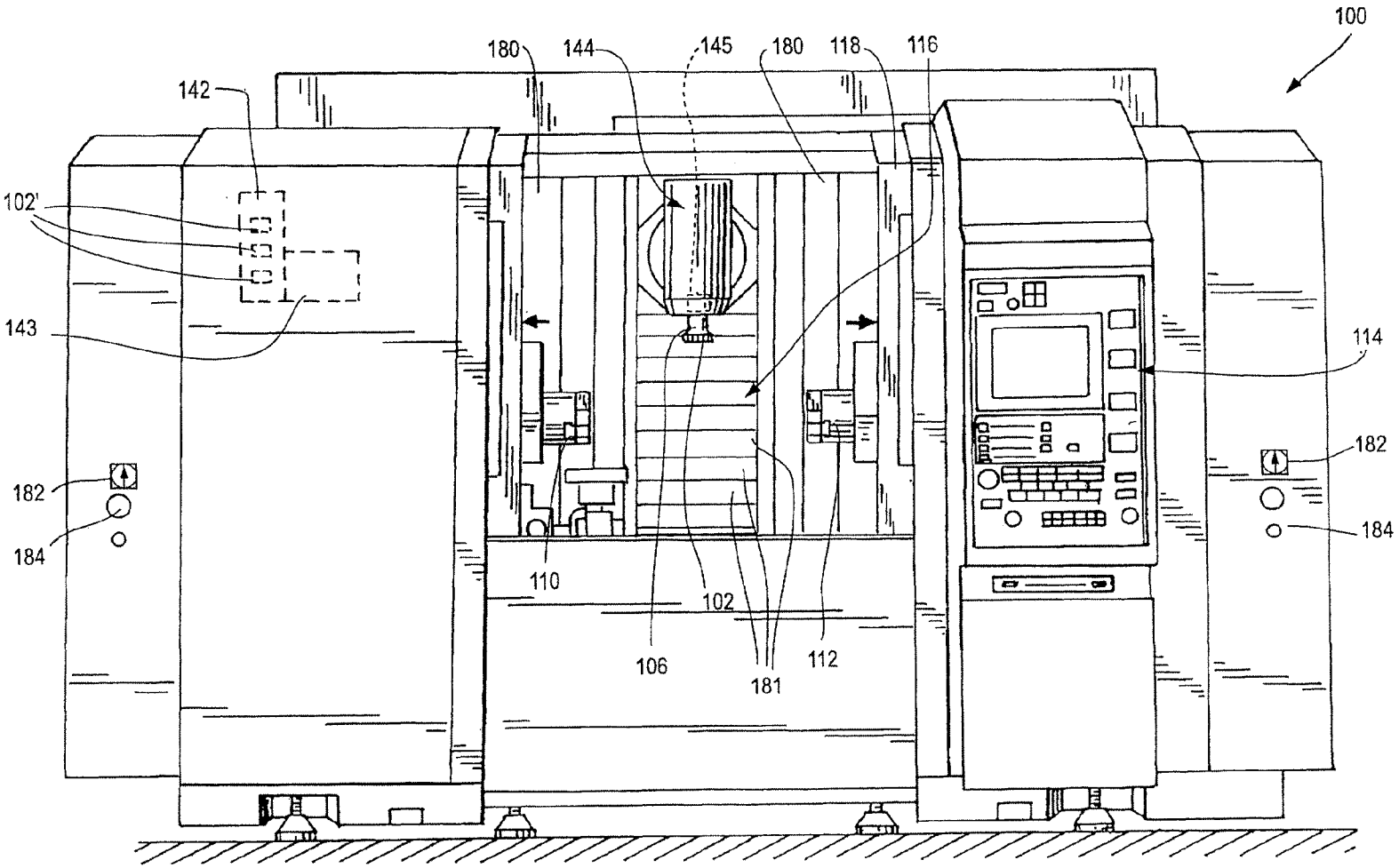
FIG. 2 is a front elevation of a computer numerically controlled machine illustrated in FIG. 1, shown with the safety doors open.
Figure 3:
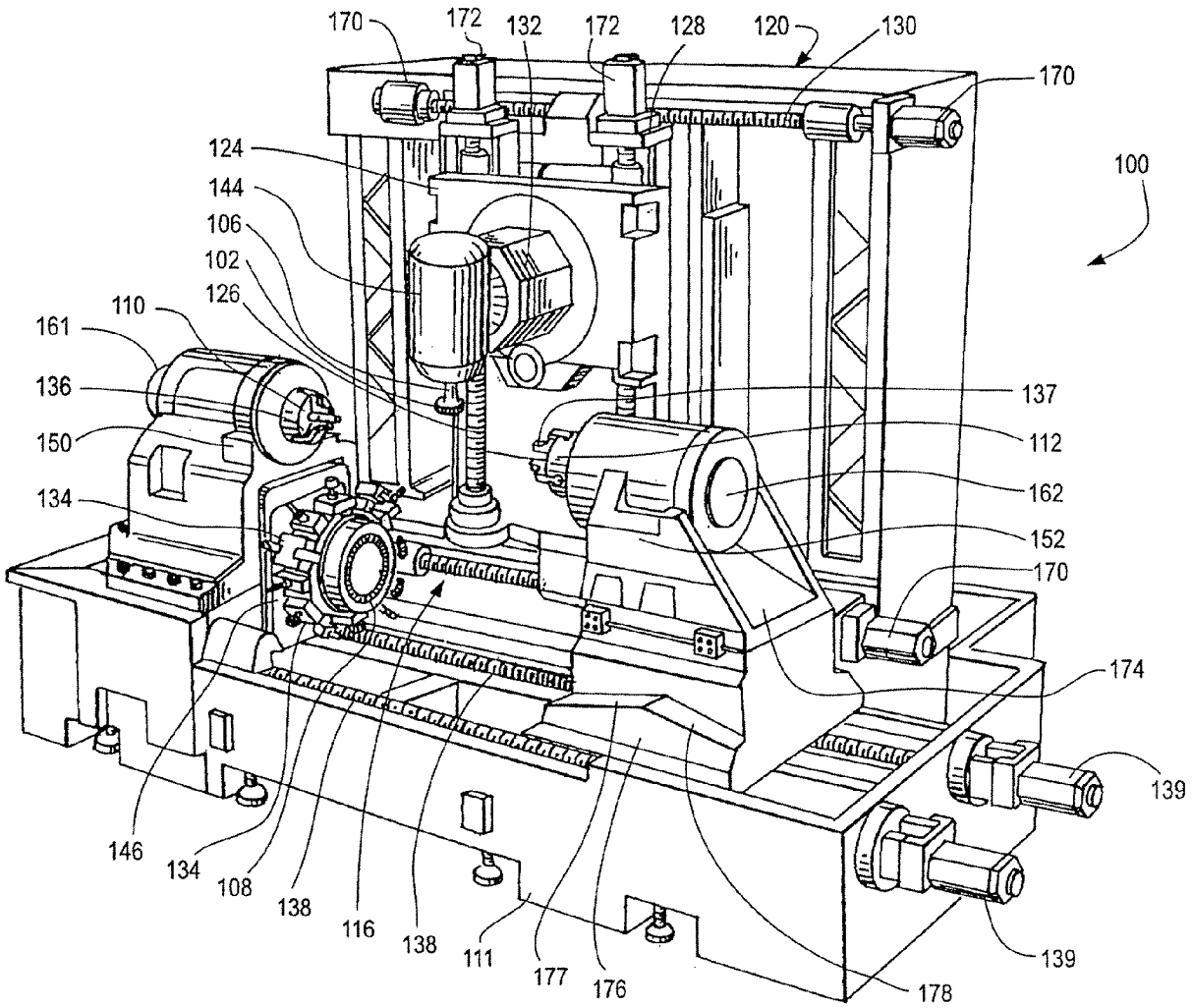
FIG. 3 is a perspective view of certain interior components of the computer numerically controlled machine illustrated in FIGS. 1 and 2, depicting a machining spindle, a first chuck, a second chuck, and a turret.

In general, with reference to the NT-series machine illustrated in FIGS. 1-3, one suitable computer numerically controlled machine 100 has at least a first retainer and a second retainer, each of which may be a tool retainer (such as a spindle retainer associated with spindle 144 or a turret retainer associated with a turret 108) or a workpiece retainer (such as chucks 110, 112). In the embodiment illustrated in the Figures, the computer numerically controlled machine 100 is provided with a spindle 144, a turret 108, a first chuck 110, and a second chuck 112. The computer numerically controlled machine 100 also has a computer control system operatively coupled to the first retainer and to the second retainer for controlling the retainers, as described in more detail below. It is understood that in some embodiments, the computer numerically controlled machine 100 may not contain all of the above components, and in other embodiments, the computer numerically controlled machine 100 may contain additional components beyond those designated herein.

As shown in FIGS. 1 and 2, the computer numerically controlled machine 100 has a machine chamber 116 in which various operations generally take place upon a workpiece (not shown). Each of the spindle 144, the turret 108, the first chuck 110, and the second chuck 112 may be completely or partially located within the machine chamber 116. In the embodiment shown, two moveable safety doors 118 separate the user from the chamber 116 to prevent injury to the user or interference in the operation of the computer numerically controlled machine 100. The safety doors 118 can be opened to permit access to the chamber 116 as illustrated in FIG. 2. The computer numerically controlled machine 100 is described herein with respect to three orthogonally oriented linear axes (X, Y, and Z), depicted in FIG. 4 and described in greater detail below. Rotational axes about the X, Y and Z axes are connoted "A," "B," and "C" rotational axes respectively.

The computer numerically controlled machine 100 is provided with a computer control system for controlling the various instrumentalities within the computer numerically controlled machine. In the illustrated embodiment, the machine is provided with two interlinked computer systems, a first computer system comprising a user interface system (shown generally at 114 in FIG. 1) and a second computer system (not illustrated) operatively connected to the first computer system. The second computer system directly controls the operations of the spindle, the turret, and the other instrumentalities of the machine, while the user interface system 114 allows an operator to control the second computer system. Collectively, the machine control system and the user interface system, together with the various mechanisms for control of operations in the machine, may be considered a single computer control system. In some embodiments, the user operates the user interface system to impart programming to the machine; in other embodiments, programs can be loaded or transferred into the machine via external sources. It is contemplated, for instance, that programs may be loaded via a PCMCIA interface, an RS-232 interface, a universal serial bus interface (USB), or a network interface, in particular a TCP/IP network interface. In other embodiments, a machine may be controlled via conventional PLC (programmable logic controller) mechanisms (not illustrated).

As further illustrated in FIGS. 1 and 2, the computer numerically controlled machine 100 may have a tool magazine 142 and a tool changing device 143. These cooperate with the spindle 144 to permit the spindle to operate with plural cutting tools (shown in FIG. 2 as tools 102'). Generally, a variety of cutting tools may be provided; in some embodiments, multiple tools of the same type may be provided.

The spindle 144 is mounted on a carriage assembly 120 that allows for translational movement along the X- and Z-axis, and on a ram 132 that allows the spindle 144 to be moved in the Y-axis. The ram 132 is equipped with a motor to allow rotation of the spindle in the B-axis, as set forth in more detail hereinbelow. As illustrated, the carriage assembly has a first carriage 124 that rides along two threaded vertical rails (one rail shown at 126) to cause the first carriage 124 and spindle 144 to translate in the X-axis. The carriage assembly also includes a second carriage 128 that rides along two horizontally disposed threaded rails (one shown in FIG. 3 at 130) to allow movement of the second carriage 128 and spindle 144 in the Z-axis. Each carriage 124, 128 engages the rails via plural ball screw devices whereby rotation of the rails 126, 130 causes translation of the carriage in the X- or Z-direction respectively. The rails are equipped with motors 170 and 172 for the horizontally disposed and vertically disposed rails respectively.

The spindle 144 holds the cutting tool 102 by way of a spindle connection and a tool retainer 106. The spindle connection 145 (shown in FIG. 2) is connected to the spindle 144 and is contained within the spindle 144. The tool retainer 106 is connected to the spindle connection and holds the cutting tool 102. Various types of spindle connections are known in the art and can be used with the computer numerically controlled machine 100. Typically, the spindle connection is contained within the spindle 144 for the life of the spindle. An access plate 122 for the spindle 144 is shown in FIGS. 5 and 6.

The first chuck 110 is provided with jaws 136 and is disposed in a stock 150 that is stationary with respect to the base 111 of the computer numerically controlled machine 100. The second chuck 112 is also provided with jaws 137, but the second chuck 112 is movable with respect to the base 111 of the computer numerically controlled machine 100. More specifically, the machine 100 is provided with threaded rails 138 and motors 139 for causing translation in the Z-direction of the second stock 152 via a ball screw mechanism as heretofore described. To assist in swarf removal, the stock 152 is provided with a sloped distal surface 174 and a side frame 176 with Z-sloped surfaces 177, 178. Hydraulic controls and associated indicators for the chucks 110, 112 may be provided, such as the pressure gauges 182 and control knobs 184 shown in FIGS. 1 and 2. Each stock is provided with a motor (161, 162 respectively) for causing rotation of the chuck.

Figure 5:
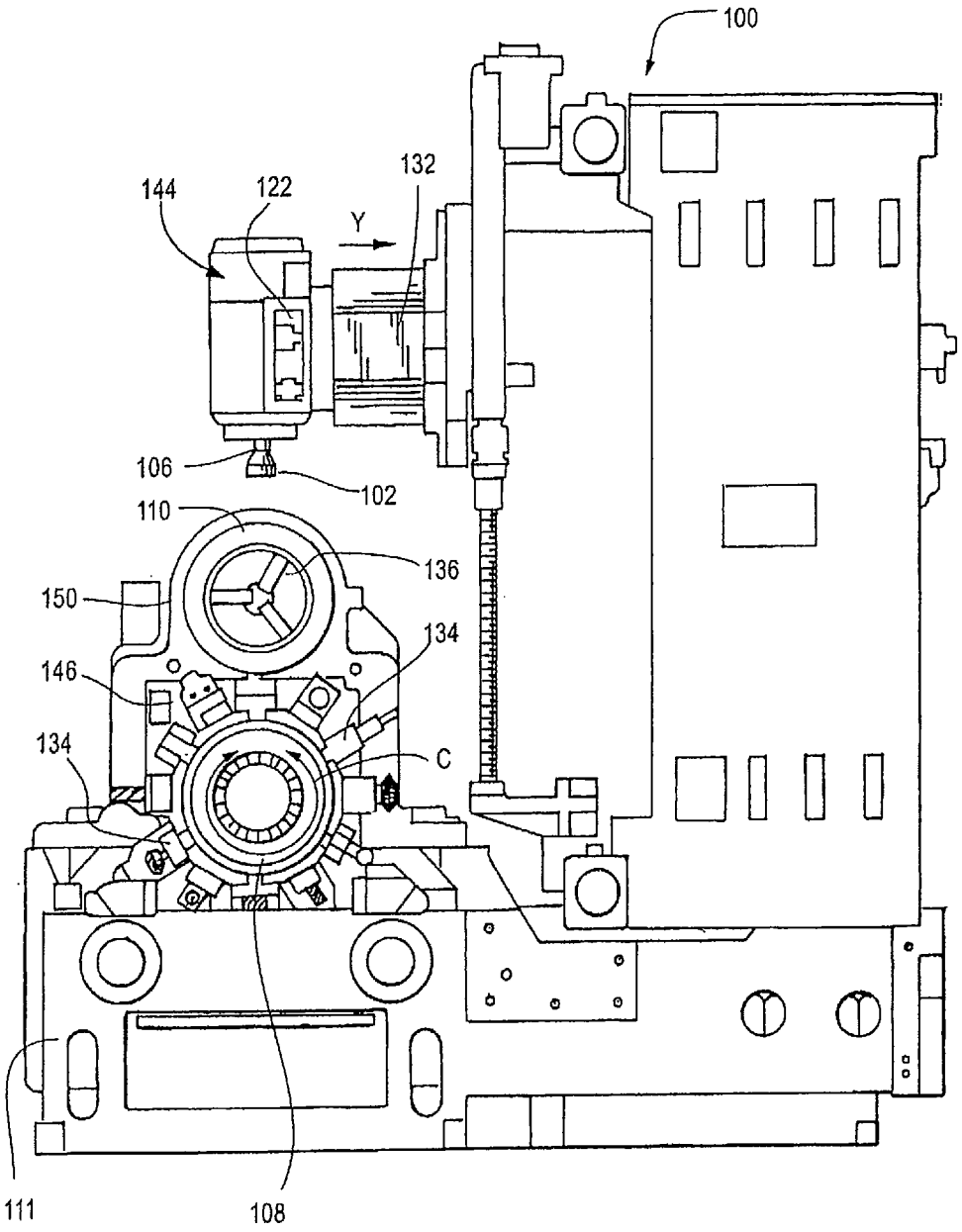
FIG. 5 is a side view of the first chuck, machining spindle, and turret of the machining center illustrated in FIG. 1.
Figure 6:
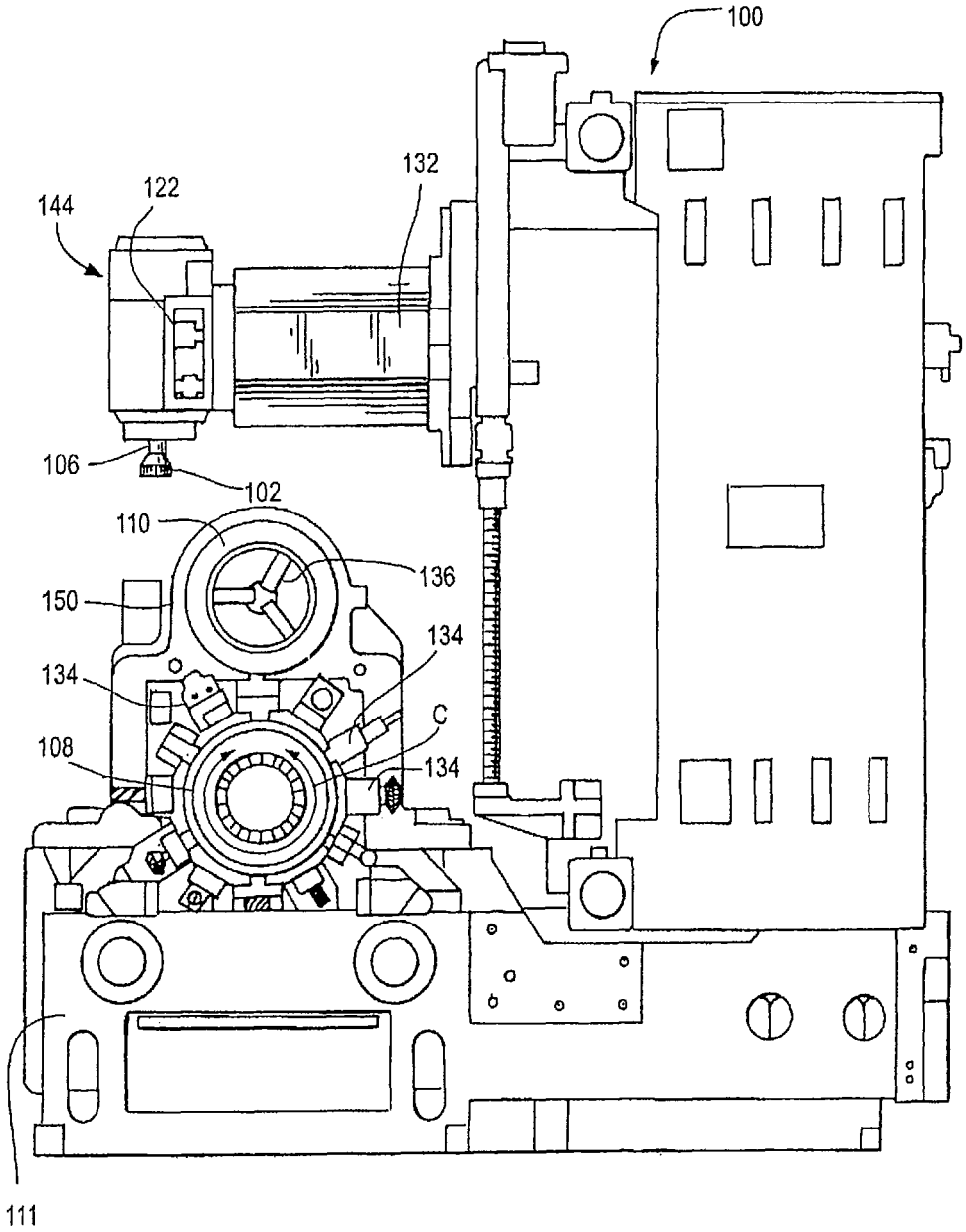
FIG. 6 is a view similar to FIG. 5 but in which a machining spindle has been translated in the Y-axis.
Figure 9:
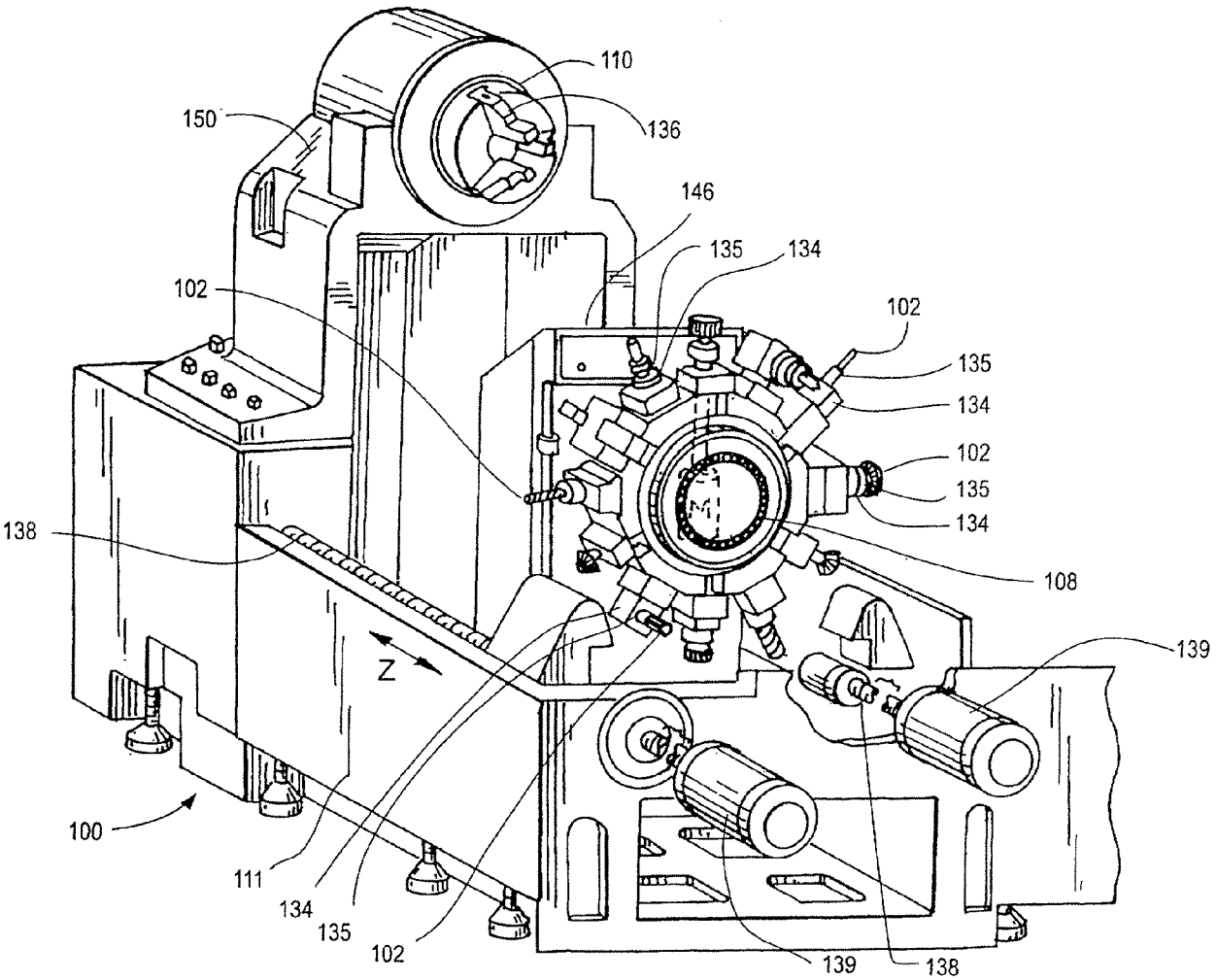
FIG. 9 is a perspective view of the first chuck and turret illustrated in FIG. 2, depicting movement of the turret and turret stock in the Z-axis relative to the position of the turret in FIG. 2.

The turret 108, which is best depicted in FIGS. 5, 6 and 9, is mounted in a turret stock 146 (FIG. 5) that also engages rails 138 and that may be translated in a Z-direction, again via ball-screw devices. The turret 108 is provided with various turret connectors 134, as illustrated in FIG. 9. Each turret connector 134 can be connected to a tool retainer 135 or other connection for connecting to a cutting tool. Since the turret 108 can have a variety of turret connectors 134 and tool retainers 135, a variety of different cutting tools can be held and operated by the turret 108. The turret 108 may be rotated in a C' axis to present different ones of the tool retainers (and hence, in many embodiments, different tools) to a workpiece.

Figure 4:
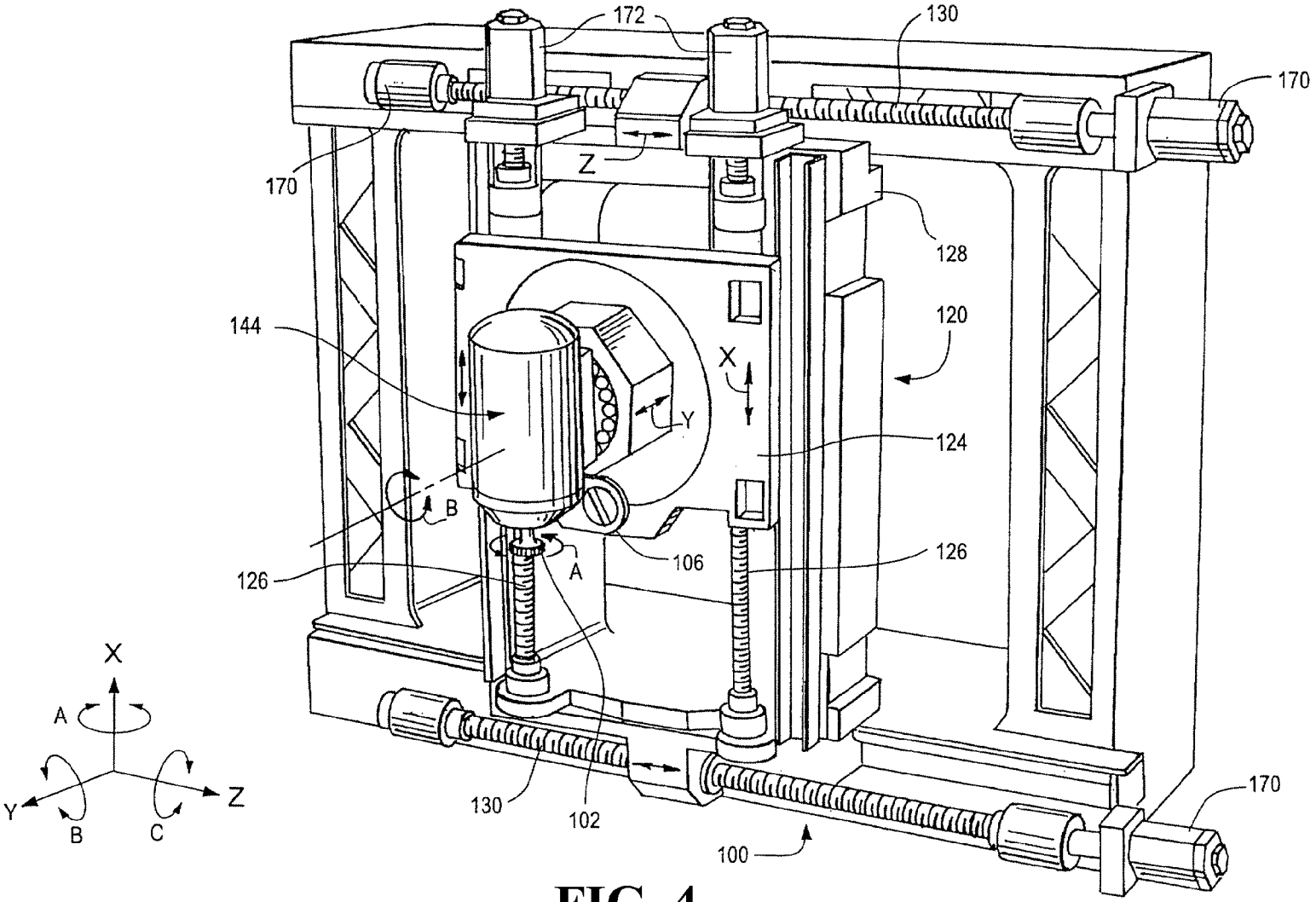
FIG. 4 a perspective view, enlarged with respect to FIG. 3 illustrating the machining spindle and the horizontally and vertically disposed rails via which the spindle may be translated.
Figure 7:
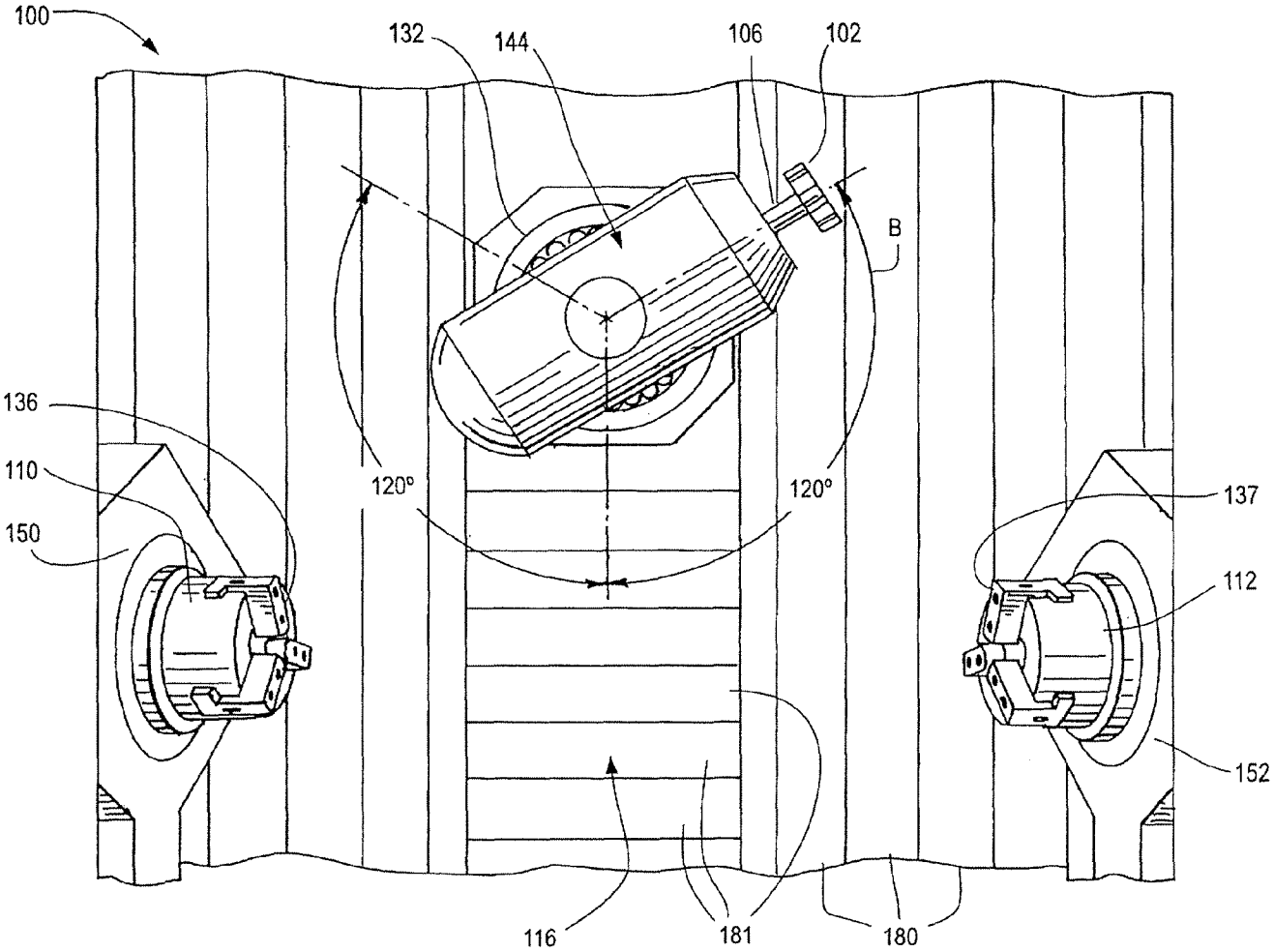
FIG. 7 is a front view of the spindle, first chuck, and second chuck of the computer numerically controlled machine illustrated in FIG. 1, including a line depicting the permitted path of rotational movement of this spindle.
Figure 8:
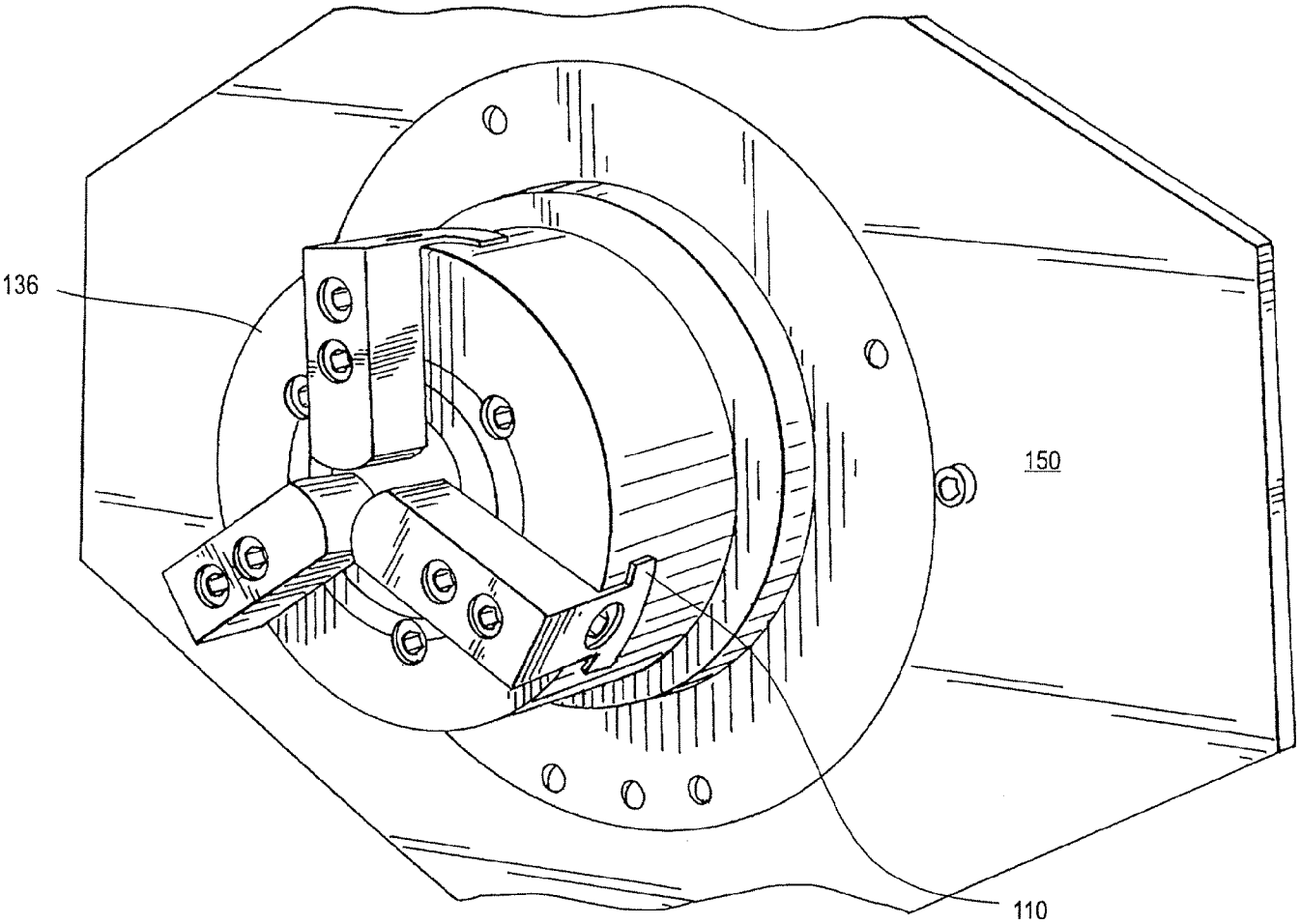
FIG. 8 is a perspective view of the second chuck illustrated in FIG. 3, enlarged with respect to FIG. 3.

It is thus seen that a wide range of versatile operations may be performed. With reference to tool 102 held in tool retainer 106, such tool 102 may be brought to bear against a workpiece (not shown) held by one or both of chucks 110, 112. When it is necessary or desirable to change the tool 102, a replacement tool 102 may be retrieved from the tool magazine 142 by means of the tool changing device 143. With reference to FIGS. 4 and 5, the spindle 144 may be translated in the X and Z directions (shown in FIG. 4) and Y direction (shown in FIGS. 5 and 6). Rotation in the B axis is depicted in FIG. 7, the illustrated embodiment permitting rotation within a range of 120 degrees to either side of the vertical. Movement in the Y direction and rotation in the B axis are powered by motors (not shown) that are located behind the carriage 124.

Generally, as seen in FIGS. 2 and 7, the machine is provided with a plurality of vertically disposed leaves 180 and horizontal disposed leaves 181 to define a wall of the chamber 116 and to prevent swarf from exiting this chamber.

The components of the machine 100 are not limited to the heretofore described components. For instance, in some instances an additional turret may be provided. In other instances, additional chucks and/or spindles may be provided. Generally, the machine is provided with one or more mechanisms for introducing a cooling liquid into the chamber 116.

In the illustrated embodiment, the computer numerically controlled machine 100 is provided with numerous retainers. Chuck 110 in combination with jaws 136 forms a retainer, as does chuck 112 in combination with jaws 137. In many instances these retainers will also be used to hold a workpiece. For instance, the chucks and associated stocks will function in a lathe-like manner as the headstock and optional tailstock for a rotating workpiece. Spindle 144 and spindle connection 145 form another retainer. Similarly, the turret 108, when equipped with plural turret connectors 134, provides a plurality of retainers (shown in FIG. 9).

The computer numerically controlled machine 100 may use any of a number of different types of cutting tools known in the art or otherwise found to be suitable. For instance, the cutting tool 102 may be a milling tool, a drilling tool, a grinding tool, a blade tool, a broaching tool, a turning tool, or any other type of cutting tool deemed appropriate in connection with a computer numerically controlled machine 100. As discussed above, the computer numerically controlled machine 100 may be provided with more than one type of cutting tool, and via the mechanisms of the tool changing device 143 and magazine 142, the spindle 144 may be caused to exchange one tool for another. Similarly, the turret 108 may be provided with one or more cutting tools 102, and the operator may switch between cutting tools 102 by causing rotation of the turret 108 to bring a new turret connector 134 into the appropriate position.

Other features of a computer numerically controlled machine include, for instance, an air blower for clearance and removal of chips, various cameras, tool calibrating devices, probes, probe receivers, and lighting features. The computer numerically controlled machine illustrated in FIGS. 1-9 is not the only machine of the invention, but to the contrary, other embodiments are envisioned.

Among other things, the computer numerically controlled machine 100 may be configured and controlled to perform grind hardening operations more efficiently and effectively than previously known machines. As shown in the exemplary embodiment of FIG. 10, for example, the computer numerically controlled machine 100 may be provided with at least a tool retainer 106 disposed on a spindle 144, a turret 108, one or more chucks or workpiece retainers 110, 112 as well as a user interface 114 configured to interface with a computer control system of the computer numerically controlled machine 100. Each of the tool retainer 106, spindle 144, turret 108 and workpiece retainers 110, 112 may be disposed within a machining area 200 and selectively rotatable and/or movable relative to one another along one or more of a variety of axes.

Figure 10:
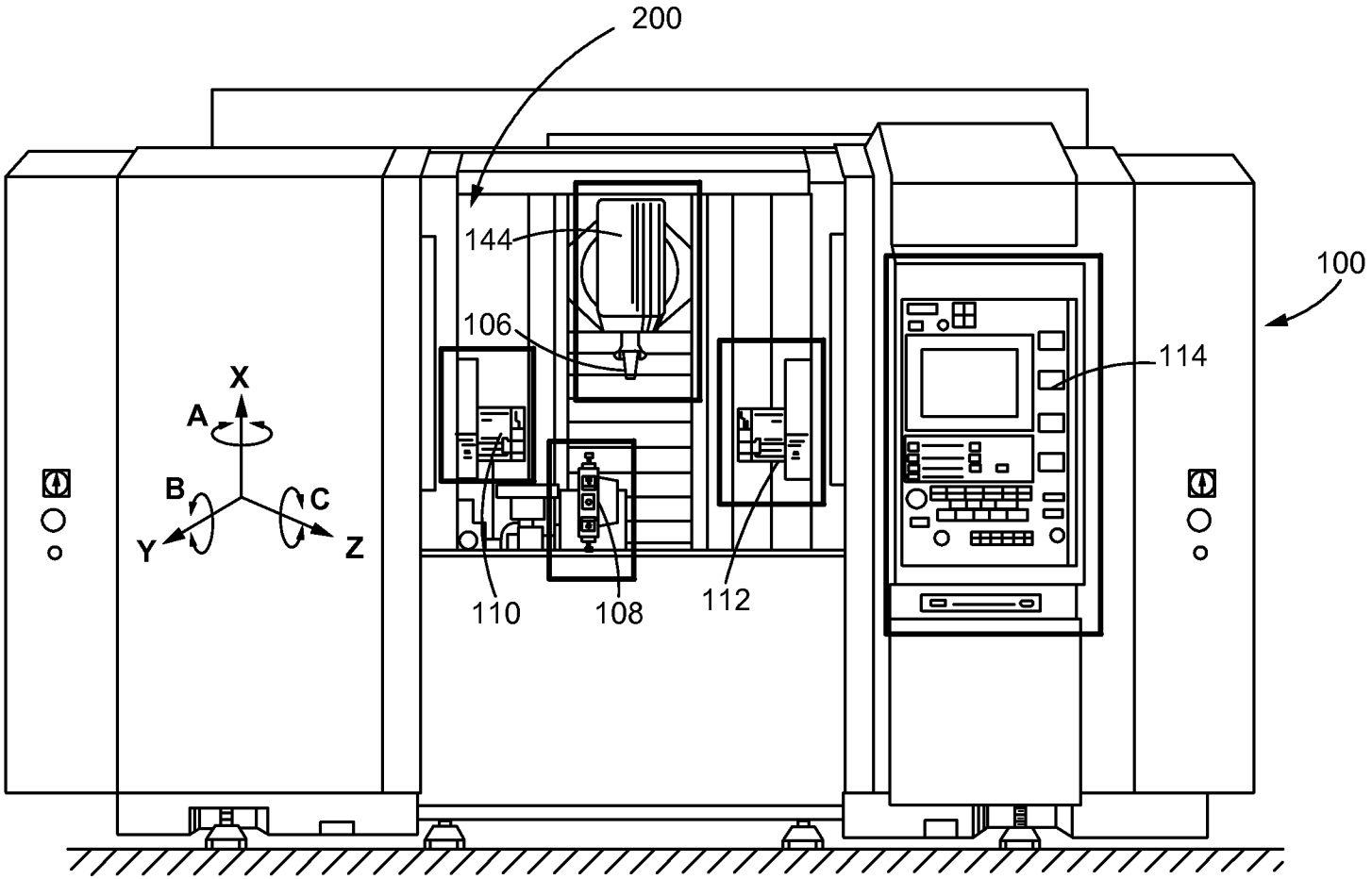
FIG. 10 is a perspective view of yet another computer numerically controlled machine in accordance with one embodiment of the present invention.

As indicated in FIG. 10, for example, the X, Y, and Z axes may indicate orthogonal directions of movement, while the A, B, and C axes may indicate rotational directions about the X, Y, and Z axes, respectively. These axes are provided to help describe movement in a three-dimensional space, and therefore, other coordinate schemes may be used without departing from the scope of the appended claims. Additionally, use of these axes to describe movement is intended to encompass actual, physical axes that are perpendicular to one another, as well as virtual axes that may not be physically perpendicular but in which the tool path is manipulated by a controller to behave as if they were physically perpendicular.

With reference to the axes shown in FIG. 10, the tool retainer 106 may be rotated about a B-axis of the spindle 144 upon which it is supported, while the spindle 144 itself may be movable along an X-axis, a Y-axis and a Z-axis. The turret 108 may be movable along an XA-axis substantially parallel to the X-axis and a ZA-axis substantially parallel to the Z axis. The workpiece retainers 110, 112 may be rotatable about a C-axis, and further, independently translatable along one or more axes relative to the machining area 200. It will be understood that the axes of movement noted above are merely exemplary, as they may be movable with respect to fewer or more than the axes identified above. Furthermore, the methods and apparatus disclosed herein may be used in conjunction with a computer numerically controlled machine that is minimally configured to enable four axes of movement when a dedicated cooling center is not provided, or a machine minimally that is configured to enable at least two axes of movement when a dedicated cooling center is provided.

Figure 11:
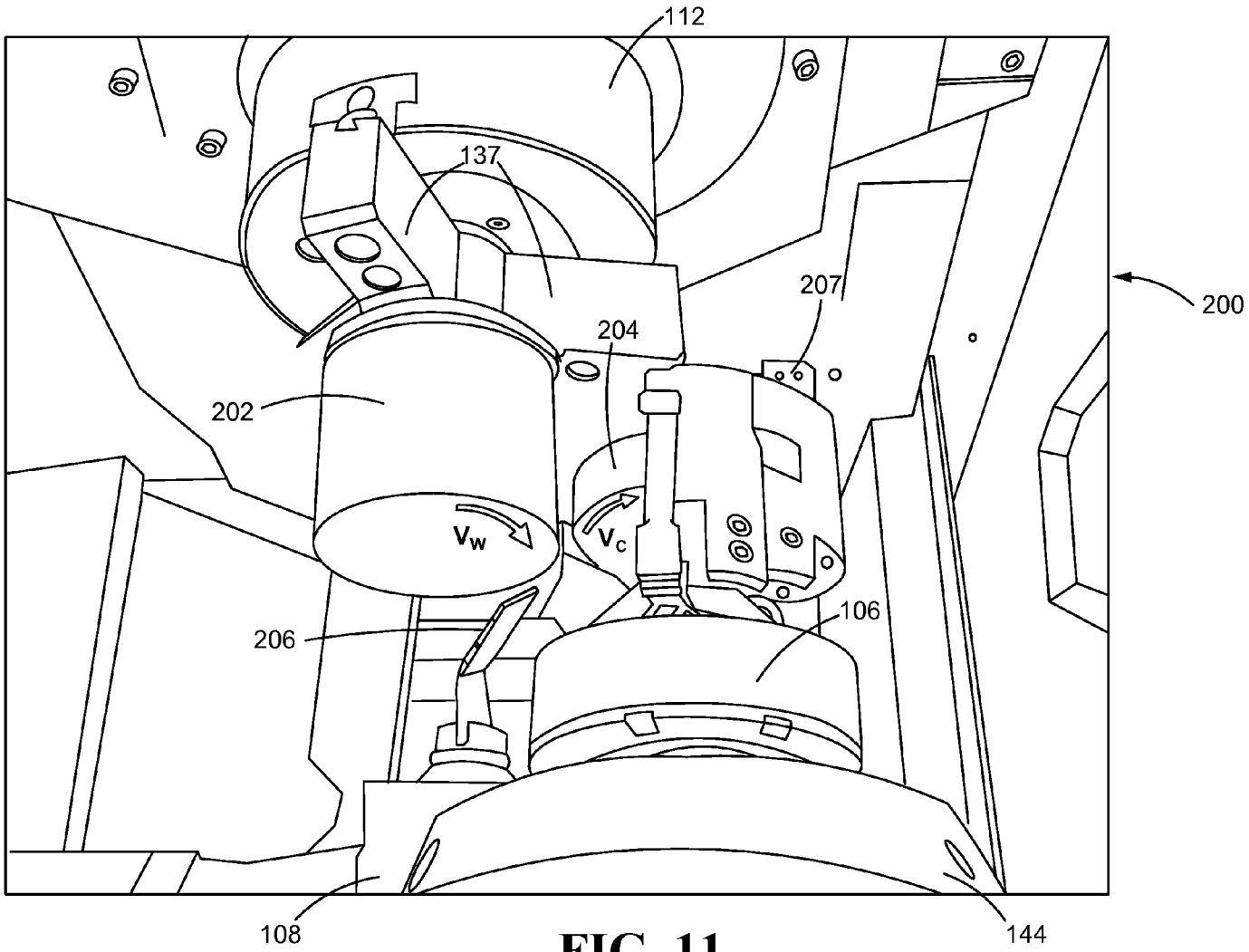
FIG. 11 is a perspective view of a machining area of the machine of FIG. 10.

Turning to FIG. 11, one exemplary arrangement of the machining area 200 for grind hardening a workpiece 202 is provided. As shown, the workpiece 202 may be movably supported by one of the workpiece retainers 112, and more particularly, secured between a plurality of jaws 137 thereof. A grind wheel or tool 204 may be similarly supported and secured by the tool retainer 106 of the spindle 144. Moreover, one or more of the workpiece retainer 112 and the tool retainer 106 may be positioned such that the grinding surface of the grind wheel 204 is readily capable of engaging even and adequate contact with the work surface of the workpiece 202 as shown.

The computer numerically controlled machine 100 may additionally provide a coolant nozzle 206, or the like, which may also be disposed within the machining area 200 and supported by the turret 108. Specifically, the coolant nozzle 206 may be configured to selectively dispense a coolant, a lubricant or any other suitable cooling agent that is adapted to dissipate any excess heat that may be generated during a grind hardening process. As shown in FIG. 11, for instance, the coolant nozzle 206 may be positioned such that at least one outlet thereof is approximately aligned with the contact area between the workpiece 202 and the grind tool 204. Furthermore, the position of the coolant nozzle 206 may be movable by the machine 100 along and/or rotatable about two linear axes.

Additionally, the machine 100 may provide a cleaning nozzle 207 positioned in proximity to the grind tool 204 as shown. More particularly, the cleaning nozzle 207 may include a low pressure nozzle, a high pressure nozzle, or any combination thereof, configured to dispense a cleaning agent, such as a coolant, a lubricant, or the like, and aid removal of excess debris from the contact area between the grind tool 204 and the workpiece 202 during operation. The cleaning nozzle 207 may further provide a network of tubing for dispensing the coolant through a plurality of nozzles, for example, two or more. The one or more cleaning nozzles 207 may be disposed on and selectively operated through the controls associated with the tool retainer 106 and/or the spindle 144 of the machine 100. The coolant may be supplied by the tool retainer 106 and/or the associated spindle 144. Furthermore, the position of the coolant nozzles 206 may be movable by the machine 100 along and/or rotatable about two linear axes.

Each of the coolant nozzle 206 and the cleaning nozzle 207 may be in fluid communication with a single source of cooling agent or coolant, which may further be internally provided by the machine 100 or provided by an external source. Furthermore, the volume and/or the pressure of the cooling agent that is dispensed through the coolant and cleaning nozzles 206, 207 may be selectively varied through control of the associated pump speed. The machine 100 may also be able to mechanically and/or electronically enable or disable the coolant and/or cleaning nozzles 206, 207 individually to provide more control over the amount of coolant being dispensed and the amount of heat being generated between the grind tool 204 and the workpiece 202. The cleaning nozzle 207 may also be implemented as a dedicated cleaning system, for example, having a dedicated high pressure coolant pump and an appropriate network of tubing associated with the cleaning nozzle 207. In still further modifications, the machine 100 may be configured to adjust control of the coolant that is dispensed through each of the coolant nozzle 206 and the cleaning nozzle 206 in a manner which reduces the overall volume of coolant being dispensed, improves the thermal efficiency of the grind hardening process as well as reduces the respective loads on the grind tool 204, the tool retainer 106, the spindle 144 and the machine 100, as will be understood more fully further below.

Figure 12:
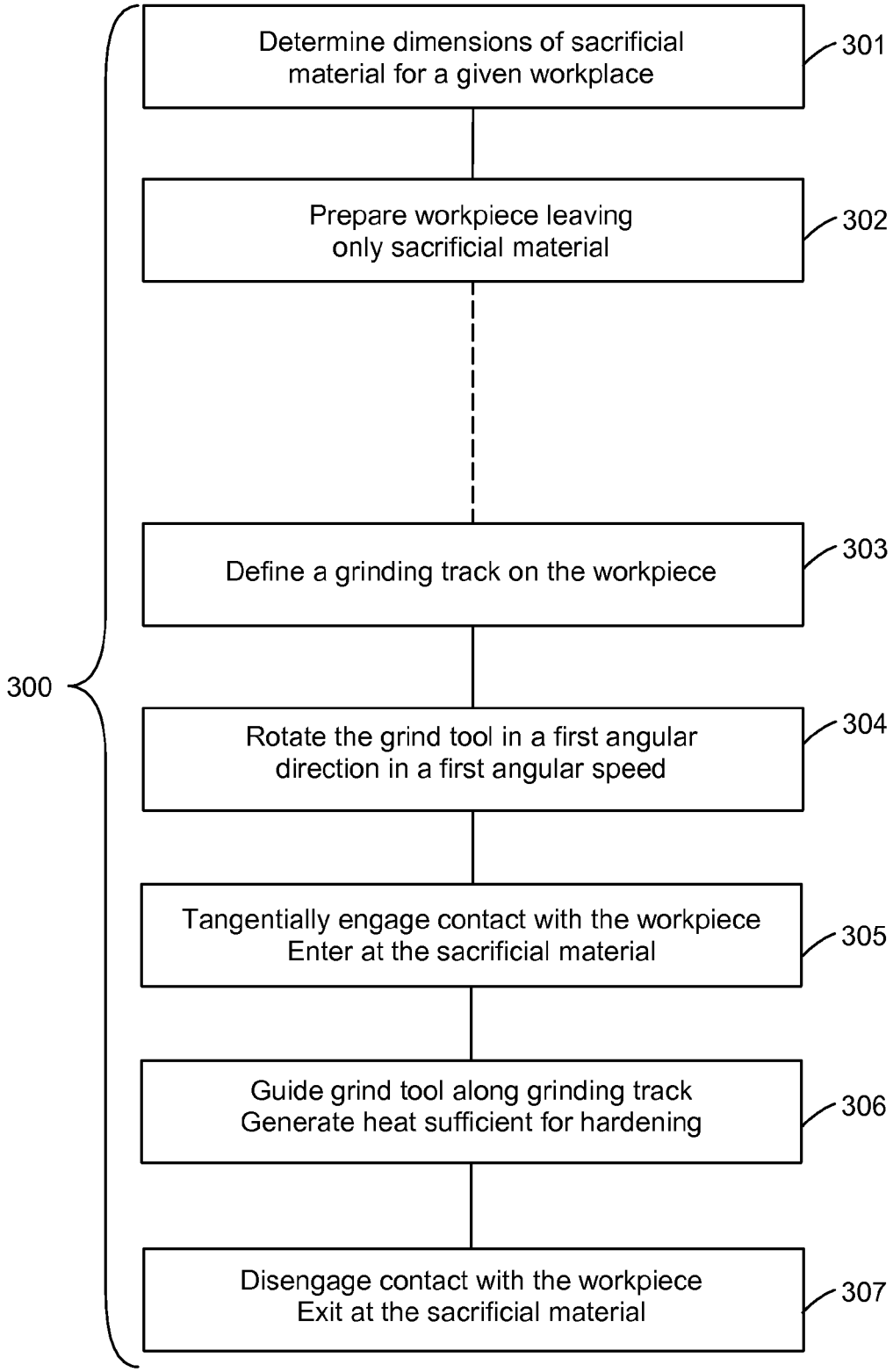
FIG. 12 is a diagrammatic view of one exemplary algorithm for engaging a computer numerically controlled machine in a grind hardening operation.

Still referring to FIGS. 10 and 11, the computer control system of the machine 100 may be operatively coupled to one or more of the tool retainer 106, the turret 108, the workpiece retainer 112, the spindle 144 and the coolant and cleaning nozzles 206, 207, and further, may be preprogrammed with an algorithm or a set of instructions for executing a grind hardening sequence or subroutine. In particular, the computer control system may include or at least communicate with a computer readable medium having computer executable code disposed thereon configured to instruct the computer control system and the machine 100 to function according to the algorithm or a series of method steps. As shown in FIG. 12, for instance, one such algorithm or method 300 of grinding hardening a workpiece 202, such as a cylindrical workpiece, is provided having a plurality of steps 301-307 that may be selectively executed by the computer control system and performed by the machine 100. Furthermore, the method 300 of FIG. 12 may generally be categorized into two or more subroutines. For example, steps 301-302 may correspond to an iteration of a pre-grind subroutine that may be executed prior to grind hardening, while steps 303-307 may correspond to an iteration of the grind hardening subroutine, as discussed in more detail below.

Figure 14:
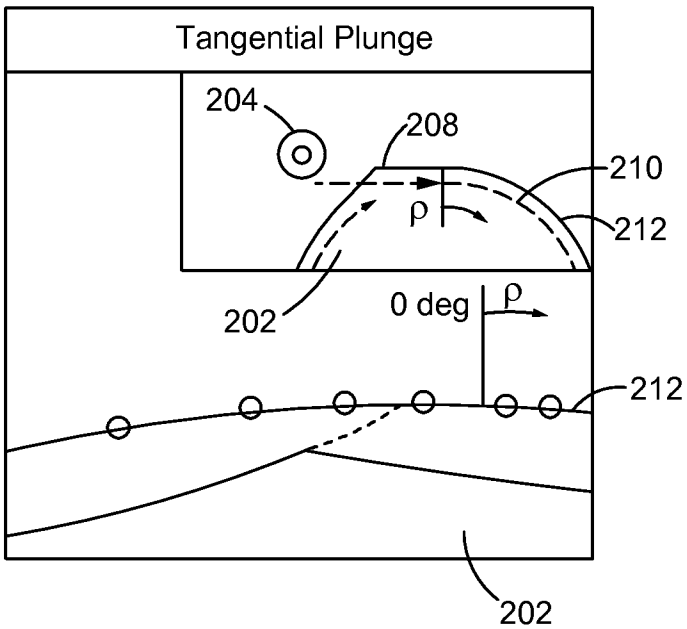
FIG. 14 is a cross-sectional view of a workpiece that has been grind hardened according to the teachings of the present disclosure.
Figure 13:
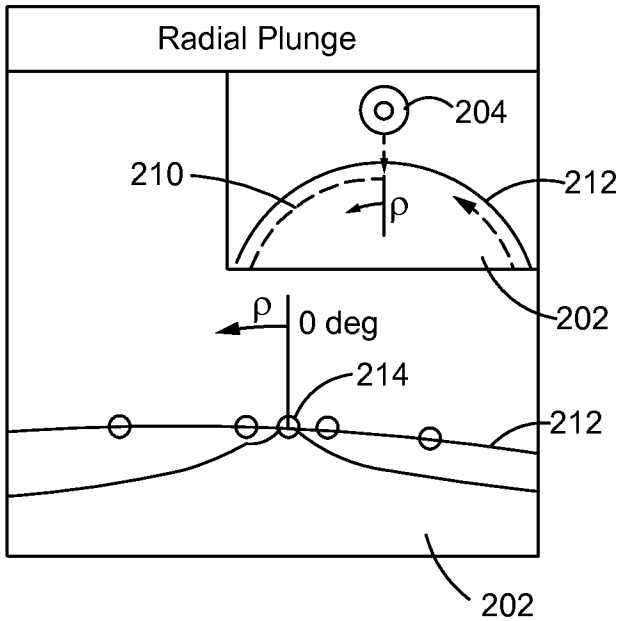
FIG. 13 (Prior Art)
FIG. 13 is a cross-sectional view of a workpiece that has been grind hardened according to the prior art.

In general, the first subroutine, for example, steps 301-302 may be configured to prepare a workpiece 202, such as a cylindrical workpiece, for grind hardening prior to or during the soft-machining stage of production. More specifically, the pre-grind subroutine may serve to provide sacrificial material on the work surface of the workpiece 202 to be beneficially incorporated and used in conjunction with the grind hardening subroutine that is performed later. As used herein, sacrificial material may be a localized area of additional material intentionally left on the soft-machined workpiece which increases the amount of workpiece material that is removed from this area during grind hardening. For a cylindrical workpiece, for example, the sacrificial material may be a localized area of increased thickness at the point of initial engagement of the tool. For a linear workpiece, for example, the sacrificial material may be localized areas of increased length at the longitudinal ends of the soft-machined workpiece, or alternatively, localized areas of increased thickness at the longitudinal ends. Sacrificial material may be provided on the surface of the workpiece 202 by preserving some of the original workpiece material during the soft-machining processes. As demonstrated in FIGS. 13 and 14, by using the residual or sacrificial material 208 as starting and ending points of a desired grinding track 210, and plunging or engaging contact between the workpiece 202 and the grind tool 204 at those points, as will be discussed more specifically with regards to the grind hardening subroutine below, it may be possible to provide a more consistent and uniform hardness about the work surface 212 of the workpiece 202 and prevent soft spots or hardness gaps 214 which often result from the prior art techniques.

Figure 15:
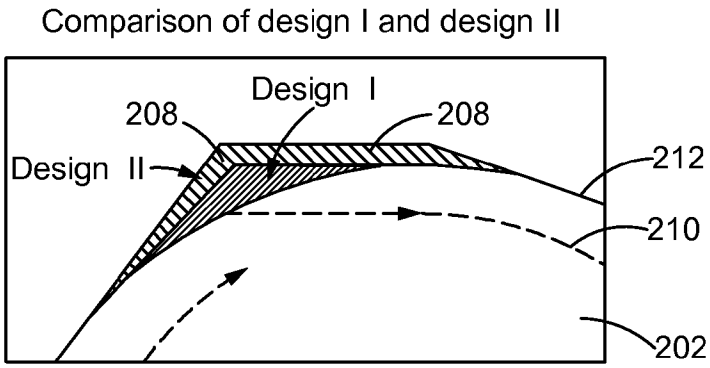
FIG. 15 is a cross-sectional view of a workpiece that has been provided with sacrificial material in accordance with the teachings of the present disclosure.

Therefore, in accordance with the first subroutine of method 300 of FIG. 12, the computer control system of the machine 100 may initially be configured to prepare the workpiece 202 for grind hardening and provide sacrificial material 208 thereto. More specifically, prior to or during any soft-machining processes on the workpiece 202, and further, prior to any grinding or hardening processes, the computer control system may be configured to determine the amount of original workpiece material, or the size and dimensions of the sacrificial material 208, to be preserved on the work surface 212 of the workpiece 202 in step 301. As illustrated by Designs I and II of FIG. 15, for example, the sacrificial material 208 may be configured according to any number of different designs. As further illustrated in FIGS. 16 and 17, the general dimensions of the sacrificial material 208 may be determined based at least partially on the plunge depth, $a_{e,pl}$, the diameter of the grind tool, $d_{gw}$, as well as any other appropriate parameters. More specifically, the minimal length of the sacrificial material 208, $l_{s,min}$, may be defined by the following relationships $$l_g=\sqrt{a_{e,pl}\cdot d_{gw}} \tag{1}$$

$$l_{s,min}=\sqrt{l_g^2-a_{e,pl}^2} \tag{2}$$

$$l_{s,min}=\sqrt{a_{e,pl}(d_{gw}-a_{e,pl})} \tag{3}$$

where $l_g$ is the length of the plunge or the contact area between the grind tool 204 and the workpiece 202. Based on the size of the grind tool 204 and the desired cut depth, or the depth at which the grinding track 210 is defined beneath the work surface 212, it may be possible to determine the minimal length of the sacrificial material 208 which enables appropriate and uniform hardening of the workpiece 202.

Figure 16:
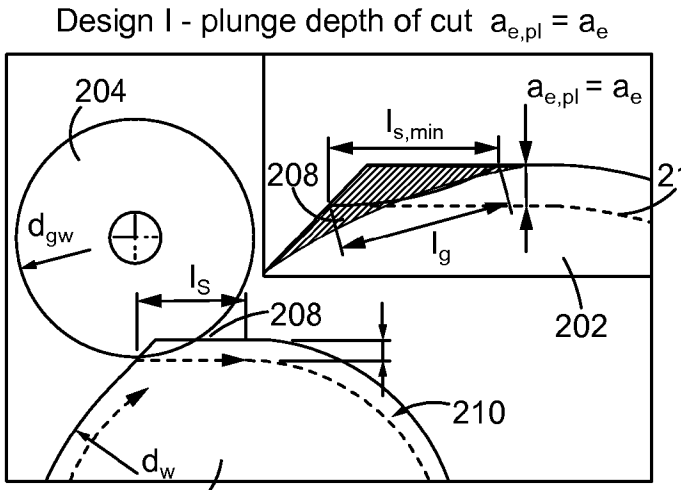
FIG. 16 is a cross-sectional view of a grind tool tangentially engaging a workpiece.
Figure 17:
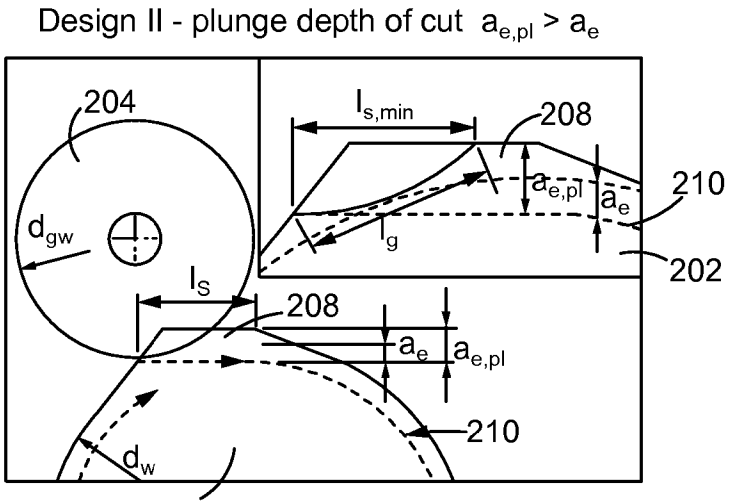
FIG. 17 is a cross-sectional view of a grind tool tangentially engaging another workpiece.

For example, in Design I of FIG. 16, the plunge depth, $a_{e,pl}$, may be selected to be equal to the cut depth, $a_e$, or the depth of the grinding track 210. Accordingly, the upper edge of the sacrificial material 208 may be substantially level and continuous with the work surface 212 of the workpiece 202. In contrast, with regards to Design II of FIG. 17, for instance, the plunge depth, $a_{e,pl}$, may be selected to be greater than the cut depth, $a_e$, and thus, the upper edge of the resulting sacrificial material 208 may be raised and discontinuous relative to the work surface 212 of the workpiece 202. In both designs, however, the minimal length of the sacrificial material 208 may be determined based on the size of the grind tool 204 and the cut depth, or the desired depth of the grinding track 210.

Once the dimensions of the sacrificial material 208 have been established, the computer control system of the machine 100 may be configured to proceed with any soft-machining or otherwise pre-grind processes while preserving the sacrificial material 208 thereon as in step 302 of FIG. 12. In particular, the machine 100 may perform milling, drilling, broaching, turning, or any other type of cutting or soft-machining operation on the workpiece 202, but proceed with such processes without affecting those areas designated as the sacrificial material 208 and defined during step 301. The computer control system may incorporate structural parameters corresponding to the dimensions of the sacrificial material 208 into the workpiece design using any number of different techniques commonly used in the art of computer numerically controlled machining.

Figure 18:
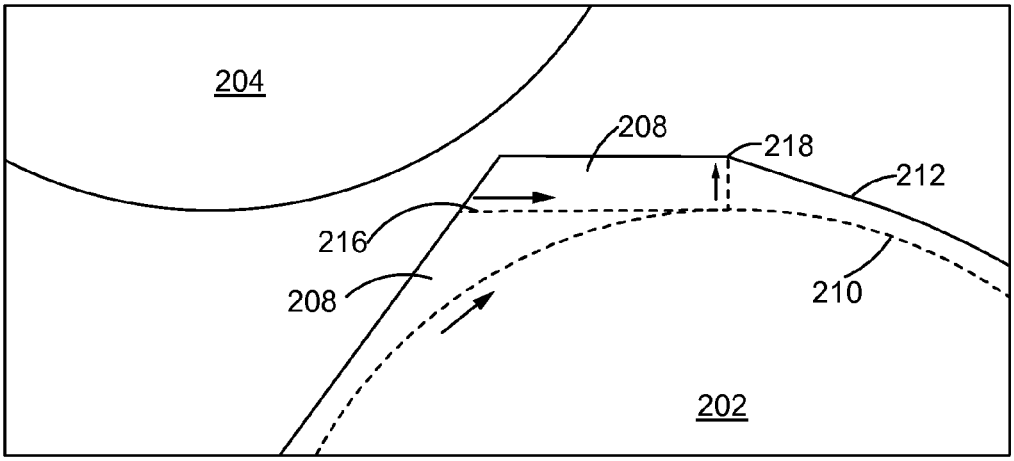
FIG. 18 is a cross-sectional view of a grind tool prior to tangentially engaging a workpiece.

Referring now to the grind hardening subroutine of FIG. 12, the computer control system of the machine 100 may initially define a grinding track 210 on the workpiece 202 in an initial step 303. As shown on the cylindrical workpiece 202 of FIG. 18, for instance, the grinding track 210 may be defined at a predetermined depth beneath the work surface 212 of the workpiece 202 to indicate the intended path of travel of the grind tool 204 thereabout. Moreover, the computer control system of the machine 100 may configure the grinding track 210 according to the desired size and/or shape of the workpiece 202 and according to the surface which it intends to grind as well as harden. The computer control system of the machine 100 may define the grinding track 210 as generally extending between a plunge in or starting point 216 and a plunge out or ending point 218. As shown, the starting point 216 of the grinding track 210 may enter in a direction that is substantially tangent, or approximately tangent, with respect to the workpiece 202, and through a first portion of sacrificial material 208 disposed thereon. Alternatively, the plunge direction may follow a different path, such as a substantially radial path, relative to the workpiece 202. The grinding track 210 may continue about the general circumference of the cylindrical workpiece 202 until it completes approximately one revolution thereabout. As the grinding track 210 approaches or returns to the starting point 216, the grinding track 210 may be configured to extend through a second or a remaining portion of the sacrificial material 208. Subsequently, once at the ending point 218, the grinding track 210 may exit radially or otherwise relative to the workpiece 202 so as to disengage contact between the grind tool 204 and the workpiece 202. Notably, each of the starting and ending points 216, 218 may be positioned where the sacrificial material 208 is initially disposed. Removal of the sacrificial material by grinding generates additional heat in the adjacent portions of the workpiece, thereby substantially eliminating soft spots and enabling more consistent and uniform surface hardness about the workpiece 202.

In accordance with the method 300 of FIG. 12, once a grinding track 210 has been established, the computer control system of the machine 100 may be configured to begin operation of the grind tool 204 in step 304. More particularly, the computer control system may operate the tool retainer 106 so as to rotate the grind tool 204 about the central axis of the tool retainer 106, for example, the C-axis, in a first angular direction at a first predetermined angular speed, $v_c$. The rotational direction and speed of the grind tool 204, as well as the rotational direction and speed of the workpiece 202, $v_w$, may be directly related to the amount of heat that is generated between the grind tool 204 and the workpiece 202, and thus, the degree of hardening that is provided to the work surfaces 212 of the workpiece 202. Accordingly, in order to determine the appropriate relative speeds of the grind tool 204 and the workpiece 202 for optimum hardening, the computer control system may take a variety of factors into consideration, including for instance, the size of the grind tool 204, the size of the workpiece 202, the general length and duration of contact anticipated between the grind tool 204 and the workpiece 202, the anticipated plunge depth, the amount of heat that is required to sufficiently harden the material of the workpiece 202, and the like. In some embodiments, the computer control system may be configured to establish more direct and simplified correlations between the level of heat that is required to sufficiently harden the workpiece 202 and the control parameters associated with the grind tool 204. For example, the computer control system may be preprogrammed to incorporate the following relationships $$t_c = l_g / v_w \tag{4}$$

$$l_g = \sqrt{a_{e,pl} \cdot d_{gw}} \tag{5}$$

where $t_c$ represents the contact time, $l_g$ represents a contact length, $v_w$ represents the angular speed of the workpiece, $a_{e,pl}$ represents a plunge depth, and $d_{gw}$ represents a diameter of the grind tool. By associating the anticipated level of heat to be generated between the grind tool 204 and the workpiece 202 with contact time and contact length, and by correlating contact time and contact length with the relative angular speeds of rotation of the grind tool 204 and the workpiece 202, the computer control system may able to characterize grind hardening processes based solely on contact time and contact length and independently from the specific dimensions of the grind tool 204 and workpiece 202.

Figure 19:
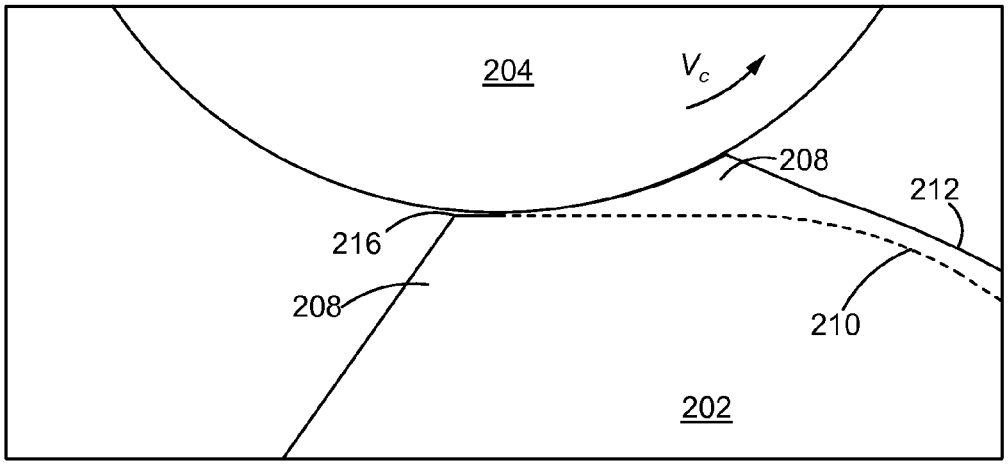
FIG. 19 is a cross-sectional view of the grind tool of FIG. 18 tangentially engaging the workpiece and removing a first portion of sacrificial material thereon.

According to step 305 of the method 300 of FIG. 12, the computer control system of the machine 100 may further be configured to engage contact between the grind tool 204 and the workpiece 202. More specifically, the computer control system may operate the tool retainer 106 and/or the spindle 144 to which the tool retainer 106 is attached such that the rotating grind tool 204 substantially tangentially engages the workpiece 202, as shown for example in FIG. 19. As shown, the outermost surface of the grind tool 204 may enter at the starting point 216 of the grinding track 210 to plunge into a first portion of the sacrificial material 208 of the workpiece 202. Alternatively, the computer control system may operate the workpiece retainer 112 so as to translate the workpiece 202 toward the grind tool 204 in a manner which enables the grind tool 204 to substantially tangentially engage the workpiece 202. In still further alternatives, the computer control system may operate each of the tool retainer 106 and the workpiece retainer 112 so as to enable substantially tangential engagement between the grind tool 204 and the workpiece 202.

Figure 20:
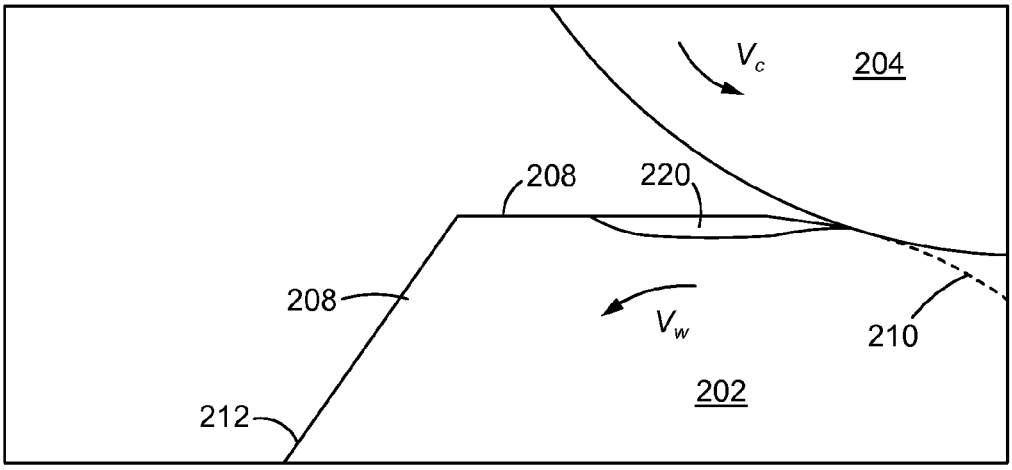
FIG. 20 is a cross-sectional view of the grind tool of FIG. 18 being guided along the grinding track of the workpiece.

In step 306 of the method 300 of FIG. 12, the computer control system of the machine 100 may further be configured to guide the grind tool 204 about the workpiece 202 and along the grinding track 210 so as to generate sufficient heat for hardening. As shown in FIG. 20, for example, the computer control system may cause the workpiece retainer 112 to rotate the workpiece 202 about a central axis thereof, or the C-axis, such that the guide tool 204 is guided along the grinding track 210. Moreover, the computer control system may maintain the position of the tool retainer 106 relative to the workpiece 202 and cause only the workpiece 202 to rotate. As shown, the workpiece 202 may be rotated in the first angular direction, or in the same direction of rotation of the grind tool 204, but at a second angular speed, $v_w$, that is substantially less than the rotational speed of the grind tool 204. The relative speeds of the grind tool 204 and the workpiece 202 may be configured to be sufficient for not only grinding away the work surface 212 of the workpiece 202, but also for generating the appropriate amount of heat for hardening the surfaces of the workpiece 202. For instance, the workpiece 202 may be rotated at relatively low speeds which sufficiently enable the friction between the grind tool 204 and the workpiece 202 to generate heated and hardened surfaces 220 on the workpiece 202 as the guide tool 204 is guided thereabout. In other modifications, the computer control system may not rotate the workpiece 202, but rather, cause the tool retainer 106 to circularly move the grind tool 204 about the workpiece 202 along the grinding track 210. Alternatively, each of the tool retainer 106 as well as the workpiece retainer 112 may be caused to move relative to one another so as to guide the grind tool 204 along the grinding track 210. In still further alternative embodiments, one or more of the tool retainer 106 and the workpiece retainer 112 may be operated to perform gradient hardening so as to provide a workpiece having varying levels of hardness or one or more intentional soft spots thereon. In such a way, the hardness applied by the grind hardening process and by the machine 100 may be controlled according to the specific workpiece at hand.

As one or more of the tool retainer 106 and the workpiece retainer 112 are operated to guide the grinding tool 204 about the grinding track 210, the computer control system may further implement a closed loop system configured to monitor any one or more of a variety of feedback parameters which may be used to provide better control of the grind hardening operation. Moreover, the computer control system may be in electrical communication with a variety of sensors, gauges, or the like, which may be pre-existing or newly implemented, to monitor or detect electrical signals corresponding to any one or more of a cut depth, an angular speed of the grind tool, an angular speed of the workpiece, a duration of contact time between the grind tool and the workpiece, a degree of wear of the grind tool, and the like. For example, the computer control system may be configured to monitor the voltage and/or in-line current of the spindle 144 associated with the tool retainer 106 and the grind tool 204 to determine variations in the cut depth. In other modifications, the computer control system may be configured to additionally or alternatively monitor the voltage and/or current corresponding to the workpiece retainer 112 to obtain feedback on a grind hardening operation.

Figure 21:
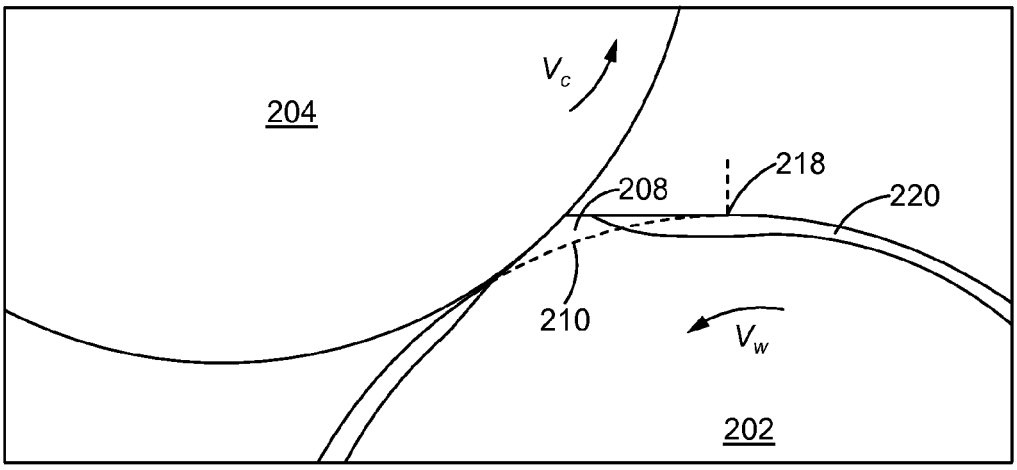
FIG. 21 is a cross-sectional view of the grind tool of FIG. 18 being guided along the grinding track of the workpiece and removing a second remaining portion of sacrificial material thereon.

Such feedback obtained through the closed loop system may ultimately be correlated with, for instance, the level of heat that is generated between the grind tool 204 and the workpiece 202. Based on such feedback parameters, the computer control system may be able to adjust or to make the appropriate corrections to one or more control parameters associated with operating the tool retainer 106, the spindle 144 and/or the workpiece retainer 112. In such a way, the grind tool 204 may progress along the grinding track 210 and circumferentially about the cylindrical workpiece 202 until the grind tool 204 approaches the ending point 218. As the grind tool 204 approaches the ending point 218 of the grinding track 210, as shown in FIG. 21, the grind tool 204 may further proceed to remove any remaining portion of the sacrificial material 208 prior to disengaging contact with the workpiece 202.

Additionally, during the grind hardening process, the machine 100 or the computer control system thereof may be configured to adjust control of the coolant that is dispensed through each of the coolant and cleaning nozzles 206, 207 in a manner which improves the thermal efficiency of the grind hardening process and reduces the overall load on the grind tool 204 and the machine 100. More specifically, dispensing a coolant through the coolant nozzle 206 during more conventional grind hardening sessions may dissipate an excess amount of heat, which may otherwise be better used to harden the workpiece 202. Furthermore, after dispensing the coolant, a greater overall load may be placed on the grind tool 204, and thus, more energy may be consumed, in order to regenerate the lost heat. Accordingly, in order to minimize the amount of desirable heat that is dissipated through coolant, and to minimize any excess energy that is spent on regenerating lost heat, the computer control system of the machine 100 may be preprogrammed with algorithms configured to restrict or limit the overall amount of coolant that is dispensed through the coolant nozzle 206 during a grind hardening session.

In particular, the computer control system may be configured to divert or partition a predefined portion of the coolant that is typically dedicated for the coolant nozzle 206 through one or more of the cleaning nozzles 207. The diversion of coolant may be accomplished using any one of a plurality of methods. For example, coolant from a single source, such as a single coolant pump, may be appropriately partitioned and routed between the coolant and the cleaning nozzles 206, 207 using any suitable network of tubing, piping, or the like, such that a predefined portion of the coolant normally dedicated for the coolant nozzle 206 may be diverted to the one or more cleaning nozzles 207. In alternative embodiments, the coolant may be supplied to the machine 100 through more than one source, such as two coolant pumps, or the like, where each pump is respectively designated for one of the coolant and cleaning nozzles 206, 207. Furthermore, each of the two coolant pumps may be appropriately configured to output coolant at different predefined volumes and/or different predefined pressures in a manner which would exhibit the effects of diverting an amount of coolant normally dedicated for the coolant nozzle 206 to the one or more cleaning nozzles 207. As the cleaning nozzles 207 may dispense a lesser volume of coolant and/or dispense coolant at a lesser rate than the coolant nozzle 206, coolant that is dispensed from the cleaning nozzles 207 may dissipate significantly less heat than coolant that is dispensed through the coolant nozzle 206. As a further result, the machine 100 may subject significantly less load on the grind tool 204, the tool retainer 106, the turret 108 and the workpiece retainers 110, 112, and further, require less overall energy in completing a grind hardening session.

In such a way, the combination of the coolant and cleaning nozzles 206, 207 may be individually controlled, for example, electrically and/or mechanically, by the computer control system of the machine 100 to perform grind hardening operations with more thermal efficiency. Such combinational use of the coolant and cleaning nozzles 206, 207 may further be guided by a closed loop system, which may provide feedback parameters that may be collectively used to monitor, for example, the degree of heat that is being generated between the grind tool 204 and the workpiece 202. In alternative modifications, parameters derived from historic or simulative data may be preprogrammed in the computer control system of the machine 100. Based on the closed loop feedback parameters, the preprogrammed parameters, or any combination thereof, the computer control system of the machine 100 may be configured to determine the appropriate combination of coolant and cleaning nozzles 206, 207 to engage in order to reduce the amount of heat that is dissipated by the coolant, and to maximize the thermal efficiency of the particular grind hardening process in session.

Figure 22:
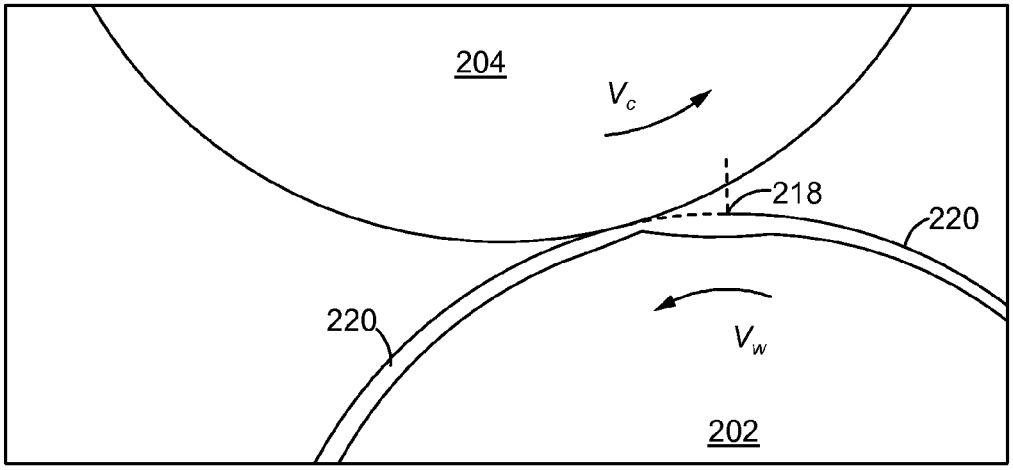
FIG. 22 is a cross-sectional view of the grind tool of FIG. 18 being guided approximately one complete revolution about the workpiece.
Figure 23:
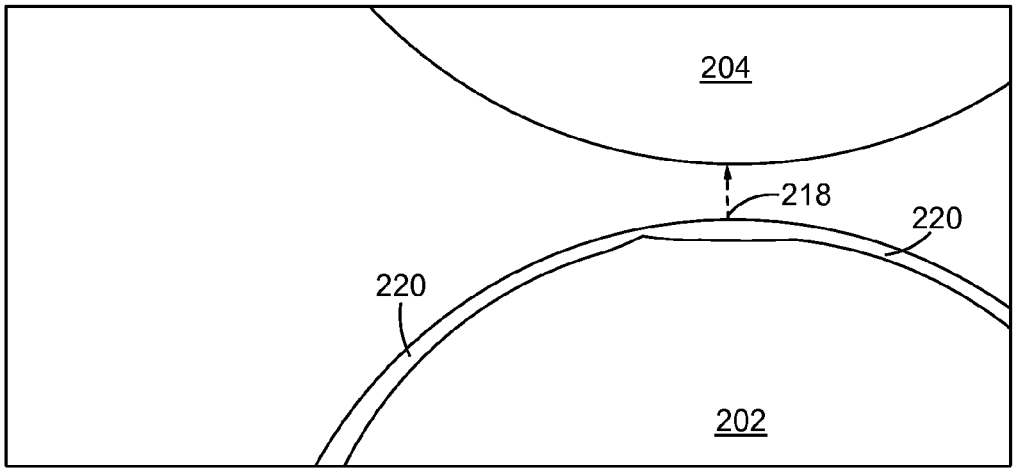
FIG. 23 is a cross-sectional view of the grind tool of FIG. 18 radially disengaging contact with the workpiece.

Once all of the remaining sacrificial material 208 has been removed from the workpiece 202, and once a continuous hardened surface 220 has been uniformly formed about the workpiece 202, as shown in FIG. 22, the computer control system of the machine 100 may be configured to disengage contact between the grind tool 204 and the workpiece 202 in step 307 of the method 300 of FIG. 12. As shown in FIG. 23, for example, the computer control system may operate the tool retainer 106 and/or the associated spindle 144 so as to substantially radially disengage the grind tool 204 from contact with the workpiece 202 at the ending point 218 of the grinding track 210. Upon disengagement, the computer control system may be configured to automatically translate or readjust the position of the grind tool 204 relative to the workpiece 202, for example, along the Z-axis, so as to execute a new grind hardening subroutine on another cross-section of the workpiece 202. In such a way, the computer control system may perform one or more reiterations of the grind hardening subroutine until all desired surfaces of the workpiece 202 are sufficiently ground and hardened. In alternative modifications, the computer control system may operate or translate the workpiece retainer 112 so as to cause the workpiece 202 to radially disengage contact with the grind tool 204. In other modifications, the computer control system may be configured to translate each of the tool retainer 106 and the workpiece retainer 112 so as to simultaneously disengage contact between the grind tool 204 and the workpiece 202. In still further modifications, the computer control system may be configured to disengage contact between the grind tool 204 and the workpiece 202 axially, tangentially, or any combination thereof, rather than radially.

Although the embodiments disclosed herein may pertain to externally cylindrical surface geometries, the present disclosure may similarly be applied to other surface geometries, such as linear surface geometries, circular surface geometries, internally cylindrical surface geometries, and the like, without departing from the scope of the appended claims. For a linear surface geometry, for example, sacrificial material may be disposed at each end of the linear surface. A corresponding grinding track may thus be defined as approximately extending between the two opposing ends, as starting and ending points, such that the grind tool may substantially tangentially plunge in at the first end of the linear surface and exit or plunge out at the second end thereof. Sacrificial material may also be disposed only at one of the two ends of the linear surface, for example, in situations where the surface hardness of either the starting point or the ending point of the grinding track defined on the workpiece is not critical. In still further modifications, sacrificial material may be disposed on neither of the starting and ending points of the grinding track, but rather, disposed on one or more sides or between where successive passes of the grind tool 204 are anticipated. Moreover, sacrificial material may be disposed along the sides of successive passes, which may take the form of linear passes, cylindrical passes, one or more helical passes, and the like. Sacrificial material may also be provided along the sides of successive passes which may be defined along the inner or outer diameters of substantially rounded workpieces. The present disclosure may similarly be applied to a workpiece that may be complex in shape having non-contiguous starting and ending points, such as an inner diameter of a connecting end portion of a connecting rod. As in prior applications, sacrificial material may be disposed at the starting point, the ending point, or any combination thereof.

Furthermore, it will be understood that the methods and apparatus disclosed may not only be applied to workpieces having circular or cylindrical cross-sections, but also to workpieces having elliptical, oval or any other substantially circular or rounded cross-sections, such as cam lobes, and the like. The methods and apparatus may also be applied to workpieces having rectangular cross-sections or substantially linear and/or angled work surfaces. The present disclosure may similarly be applied to three-dimensional grind hardening patterns which may be applied to workpieces having, for example, cylindrical, conical, helical, or other three-dimensional geometries. Still further, the present disclosure may be employed with workpieces having cross-sections of varying dimensions, such as generally conical and helical workpieces. For grind hardening a conical workpiece, for instance, the computer control system of the machine may be configured to provide sacrificial materials of varying dimensions corresponding to each cross-section of varying circumference. Accordingly, the computer control system may additionally define a new grinding track for each cross-section of varying radius, and further, perform individualized iterations of the grind hardening subroutine for each identified grinding track.

As supplied, the apparatus may or may not be provided with a tool or workpiece. An apparatus that is configured to receive a tool and workpiece is deemed to fall within the purview of the claims recited herein. Additionally, an apparatus that has been provided with both a tool and workpiece is deemed to fall within the purview of the appended claims. Except as may be otherwise claimed, the claims are not deemed to be limited to any tool depicted herein.

All references, including publications, patent applications, and patents, cited herein are hereby incorporated by reference. The description of certain embodiments as "preferred" embodiments, and other recitation of embodiments, features, or ranges as being preferred, is not deemed to be limiting, and the claims are deemed to encompass embodiments that may presently be considered to be less preferred. All methods described herein can be performed in any suitable order unless otherwise indicated herein or otherwise clearly contradicted by context. The use of any and all examples, or exemplary language (e.g., "such as") provided herein, is intended to illuminate the disclosed subject matter and does not pose a limitation on the scope of the claims. Any statement herein as to the nature or benefits of the exemplary embodiments is not intended to be limiting, and the appended claims should not be deemed to be limited by such statements. More generally, no language in the specification should be construed as indicating any non-claimed element as being essential to the practice of the claimed subject matter. The scope of the claims includes all modifications and equivalents of the subject matter recited therein as permitted by applicable law. Moreover, any combination of the above-described elements in all possible variations thereof is encompassed by the claims unless otherwise indicated herein or otherwise clearly contradicted by context. The description herein of any reference or patent, even if identified as "prior," is not intended to constitute a concession that such reference or patent is available as prior art against the present disclosure.

What is claimed is:

1. A method of grind hardening a workpiece, comprising:

securing the workpiece in a workpiece retainer, the workpiece having a work surface and sacrificial material disposed thereon;

securing a grind tool in a rotatable tool retainer;

rotating the grind tool in a first angular direction at a first angular speed;

controlling one or more of the workpiece retainer and the tool retainer such that the grind tool engages contact with the workpiece, the grind tool removing at least a portion of the sacrificial material during the engagement; and controlling one or more of the workpiece retainer and the tool retainer such that the grind tool is guided along a grinding track defined on the work surface of the workpiece and generating substantially uniform and sufficient heat to grind harden the work surface of the workpiece.

2. The method of claim 1, further comprising a step of controlling one or more of the workpiece retainer and the tool retainer such that the grind tool disengages contact with the workpiece, the grind tool removing at least a portion of the sacrificial material during the disengagement.

3. The method of claim 1, wherein the sacrificial material is disposed at one or more of a starting point of the grinding track and an ending point of the grinding track.

4. The method of claim 1, wherein one or more of the workpiece retainer and the tool retainer are controlled to engage contact with the workpiece in a direction that is substantially tangent thereto.

5. The method of claim 1, wherein the workpiece has an internally cylindrical work surface and sacrificial material at least partially disposed thereon.

6. The method of claim 1, wherein the workpiece is substantially linear in shape, the workpiece having sacrificial material disposed at one or more of a first longitudinal end thereof and a second longitudinal end thereof, the grinding track extending approximately between the first and second longitudinal ends of the workpiece and being disposed at a desired cut depth beneath the work surface of the workpiece.

7. The method of claim 1, wherein the workpiece is at least partially complex in shape, the workpiece having sacrificial material disposed at one or more of a starting point of the grinding track and an ending point of the grinding track, the starting and ending points being non-contiguous, the grinding track extending approximately between the starting and ending points thereof and being disposed at a desired cut depth beneath the work surface of the workpiece.

8. The method of claim 1, wherein the workpiece is substantially cylindrical in shape, the grinding track circumferentially extending approximately one revolution about the work surface, the sacrificial material being radially disposed at one or more of a starting point of the grinding track and an ending point of the grinding track, the grinding track being disposed at a desired cut depth beneath the work surface of the workpiece.

9. The method of claim 1, wherein the workpiece has substantially rounded cross-sections of varying circumference, the grinding track for each cross-section being individually defined, the steps of rotating the grind tool and controlling the work retainer and the tool retainer being reiterated for each grinding track.

10. The method of claim 1, wherein the sacrificial material is disposed on one or more lateral sides of the grinding track rather than at starting and ending points of the grinding track.

11. The method of claim 10, wherein the sacrificial material is disposed between anticipated successive passes of the grind tool, the successive passes being one of successive linear passes, successive cylindrical passes, successive helical passes, successive inner diameter passes, and successive outer diameter passes.

12. The method of claim 1, wherein the sacrificial material of the workpiece is provided during rough machining processes prior to grind hardening, dimensions of the sacrificial material being determined based at least partially on a desired cut depth and a diameter of the grind tool.

13. The method of claim 1, wherein control of the workpiece retainer and the tool retainer is based at least partially on feedback parameters corresponding to one or more of an actual cut depth, an angular speed of the grind tool, an angular speed of the workpiece, a duration of contact time between the grind tool and the workpiece, and a degree of wear of the grind tool.

14. The method of claim 1, wherein a level of hardening of the work surface is adjusted by positioning one or more of a coolant nozzle and at least one cleaning nozzle for dispensing a coolant in proximity to a contact area between the grind tool and the workpiece, and selectively controlling one or more of a volume and a pressure of the dispensed coolant.

15. The method of claim 1, wherein a level of hardening of the work surface is adjusted by positioning one or more of a coolant nozzle and at least one cleaning nozzle for dispensing a coolant in proximity to a contact area between the grind tool and the workpiece, one or more of the coolant and cleaning nozzles being controlled to divert at least a portion of the coolant from the coolant nozzle to the cleaning nozzle in a manner which reduces heat dissipation, improves thermal efficiency of the grind hardening and reduces loading of the grind tool.

16. A method of grind hardening a workpiece having a substantially rounded cross-section, comprising:

securing the workpiece in a rotatable workpiece retainer, the workpiece having a work surface and sacrificial material disposed thereon;

securing a grind tool in a rotatable tool retainer;

rotating the grind tool in a first angular direction at a first angular speed;

controlling the tool retainer such that the grind tool engages contact with the workpiece in a direction that is substantially tangent with the workpiece, the grind tool removing at least a portion of the sacrificial material during the engagement; and rotating the workpiece relative to the grind tool in the first angular direction at a second angular speed that is substantially less than the first angular speed such that the grind tool is guided along a grinding track circumferentially defined on the work surface of the workpiece.

17. The method of claim 16, further comprising a step of controlling the tool retainer such that the grind tool disengages contact with the workpiece, the grind tool removing at least a portion of the sacrificial material during the disengagement.

18. The method of claim 16, wherein the grinding track is defined at a desired cut depth beneath the work surface of the workpiece and circumferentially extends approximately one revolution about the work surface, the sacrificial material being radially disposed at one or more of a starting point of the grinding track and an ending point of the grinding track.

19. The method of claim 16, wherein the sacrificial material of the workpiece is provided prior to grind hardening and with dimensions that are determined based at least partially on a plunge depth and a diameter of the grind tool.

20. The method of claim 16, wherein a minimal length of the sacrificial material is determined based on the relationship $$l_{s,min}=\sqrt{a_{e,pl}(d_{gw}-a_{e,pl})}$$

where $l_{s,min}$ represents the minimal length of the sacrificial material, $a_{e,pl}$ represents a plunge depth, and $d_{gw}$ represents a diameter of the grind tool.

21. The method of claim 16, wherein a duration of contact time between the grind tool and the workpiece is related to angular speed of the workpiece based on the relationships $$t_c=l_g/v_w$$

$$l_g=\sqrt{a_{e,pl}\cdot d_{gw}}$$

where $t_c$ represents the contact time, $l_g$ represents a contact length, $v_w$ represents the angular speed of the workpiece, $a_{e,pl}$ represents a plunge depth, and $d_{gw}$ represents a diameter of the grind tool.

22. The method of claim 16, wherein each cross-section of the workpiece varies in circumference, a different grinding track being defined for each cross-section, the steps of rotating the grind tool, rotating the workpiece and controlling the tool retainer being reiterated for each grinding track.

23. The method of claim 16, wherein control of the workpiece retainer and the tool retainer is based at least partially on feedback parameters corresponding to one or more of an actual cut depth, an angular speed of the grind tool, an angular speed of the workpiece, a duration of contact time between the grind tool and the workpiece, and a degree of wear of the grind tool, the level of hardening of the work surface being adjusted by controlling one or more of the cut depth, the angular speed of the grind tool, the angular speed of the workpiece and the duration of contact time between the grind tool and the workpiece.

24. The method of claim 16, wherein a level of hardening of the work surface is adjusted by positioning one or more of a coolant nozzle and at least one cleaning nozzle for dispensing a coolant in proximity to a contact area between the grind tool and the workpiece, and selectively controlling one or more of a volume and a pressure of the dispensed coolant.

25. The method of claim 16, wherein a level of hardening of the work surface is adjusted by positioning one or more of a coolant nozzle and at least one cleaning nozzle for dispensing a coolant in proximity to a contact area between the grind tool and the workpiece, one or more of the coolant and cleaning nozzles being controlled to divert at least a portion of the coolant from the coolant nozzle to the cleaning nozzle in a manner which reduces heat dissipation, improves thermal efficiency of the grind hardening and reduces loading of the grind tool.

* * * * *